US008282418B2

(12) United States Patent
Miki et al.

(10) Patent No.: US 8,282,418 B2
(45) Date of Patent: Oct. 9, 2012

(54) CONNECTOR HAVING A SHIELD MEMBER HAVING A HOOK

(75) Inventors: Yasuyuki Miki, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 225 days.

(21) Appl. No.: 12/720,719

(22) Filed: Mar. 10, 2010

(65) Prior Publication Data

US 2010/0233906 A1 Sep. 16, 2010

(30) Foreign Application Priority Data

Mar. 11, 2009 (JP) ..... 2009-058152

(51) Int. Cl.
*H01R 9/03* (2006.01)

(52) U.S. Cl. ..... 439/607.55

(58) Field of Classification Search ..... 439/607.55, 439/701, 607.06, 607.07, 607.08
See application file for complete search history.

(56) References Cited

U.S. PATENT DOCUMENTS 6,231,391 B1 * 5/2001 Ramey et al. ..... 439/607.07
6,386,924 B2 5/2002 Long
2002/0072276 A1 * 6/2002 Lewis ..... 439/701

FOREIGN PATENT DOCUMENTS

JP 2003-529909 10/2003

* cited by examiner

*Primary Examiner* — Vanessa Girardi
(74) *Attorney, Agent, or Firm* — IPUSA, PLLC

(57) ABSTRACT

A connector includes a plurality of contact modules each including a contact member and a contact module body covering the contact member, and a plurality of shield members each including a shield body part corresponding to the contact module body of the contact module. The contact modules and the shield members are alternately arranged and accommodated close to each other in a housing. The shield body part of each shield member includes a first hook part configured to be engaged with a rear end of the contact module body in order to prevent the shield body part from turning up from the contact module body.

9 Claims, 52 Drawing Sheets

CONNECTOR HAVING A SHIELD MEMBER HAVING A HOOK

CROSS-REFERENCE TO RELATED APPLICATIONS

This application is based upon and claims the benefit of priority of the prior Japanese Patent Application No. 2009-058152, filed on Mar. 11, 2009, the entire contents of which are incorporated herein by reference.

FIELD

The present invention relates to connectors and, more particularly, to a connector used for electrically connecting circuit boards provided in an electronic device such as a communication device.

BACKGROUND

In many cases, an electronic device such as a communication device includes a backplane provided inside, and a plurality of daughter boards are attached perpendicular to the backplane. The backplane is provided with a plurality of plug connectors and a jack connector is attached to an end of each of the daughter boards so that each of the daughter boards is electrically connected to the backplane by connecting the jack connectors of the daughter boards to the plug connectors of the backplane, respectively.

With an increase in a signal transmission rate in recent years, a balanced transmission is used as a signal transmission method in many cases. The above-mentioned jack connector is configured to be usable with such a balanced transmission by having a pair of contacts for + signal transmission and − signal transmission and a shield member provided therebetween. Such a conventional jack connector has a housing in which contact modules and shield members are alternately arranged close to each other.

Normally, a plurality of jack connectors are mounted to a daughter board in a state where the jack connectors are arranged along a line close to each other. In order to provide a fixed pitch between one of the jack connectors and an adjacent one of the jack connectors, a shield member is exposed at an end of each of the jack connectors. If a plurality of jack connectors are mounted to a daughter board in a state where the jack connectors are arranged along a line close to each other, the shield member of each of the jack connectors other than that located at an end is covered by an adjacent one of the jack connectors, which prevents the shield member from being turned up.

However, until the jack connector is mounted to the daughter board, that is, for example, during handling such as a transportation time, the shield member at one end is exposed, which may cause a risk of the shield member being turned up from the contact module. If the shield member is turned up, a pitch of the jack connectors of the mount terminal in a longitudinal direction is increased, which results in difficulty in smoothly mounting the contact module to the daughter board. In order to eliminate such a problem, the conventional jack connector is provided with a turn-up preventing structure to prevent the shield member from being turned up from the contact module.

Japanese Laid-Open Patent Application No. 2003-529909 (refer to FIGS. 6-8), which corresponds to WO01/076016 of PCT/US01/12231, discloses a conventional turn-up preventing structure in which a shield member is provided with a hoop part at a middle of a height on a rear side thereof so that the hoop part fits to a projecting part provided at a middle of a height of a rear side of a contact module.

The turn-up preventing structure of the conventional jack connector is located at a middle of the height of the shield member and the contact module. Accordingly, a distance between a portion of the shield member fixed to the contact module and a mounting terminal at the lower end of the shield member is long, which may cause the turn-up preventing mechanism to provide an insufficient turn-up preventing function to the lower side of the shield member.

Additionally, because the hoop part fits to the protruding part in the conventional turn-up preventing structure, it is difficult to provide a sufficient depth by which the hoop part fits to the protruding part. Thus, the hoop part may be undesirably disengaged from the protruding part due to a shock received during transportation, and there may be a problem in that the turn-up preventing structure does not function well.

SUMMARY

There is provided according to an aspect of the invention a connector comprising: a housing; a plurality of contact modules each including a contact member and a contact module body covering the contact member; and a plurality of shield members each including a shield body part corresponding to the contact module body of the contact module, wherein the contact modules and the shield members are alternately arranged and accommodated close to each other in the housing, and the shield body part of each shield member includes a first hook part configured to be engaged with a rear end of the contact module body in order to prevent the shield body part from turning up from the contact module body.

According to the above mentioned invention, because the hook part of the shield body part engaged with the contact module body is closer to the shield member mounting terminal part as compared to a case where a portion of the shield member body engaged with the contact module body is at a middle of the height of the shield member, a portion of the shield body part on the side of the shield member mounting terminal part is effectively prevented from being turned-up from the contact module body.

The object and advantages of the embodiment will be realized and attained by means of the elements and combinations particularly pointed out in the appended claims.

It is to be understood that both the foregoing general description and the following detailed description are exemplary explanatory only and are not restrictive of the invention, as claimed.

DESCRIPTION OF EMBODIMENT(S)

Embodiments of the present invention will be explained with reference to the accompanying drawings.

First Embodiment

Figure 1:
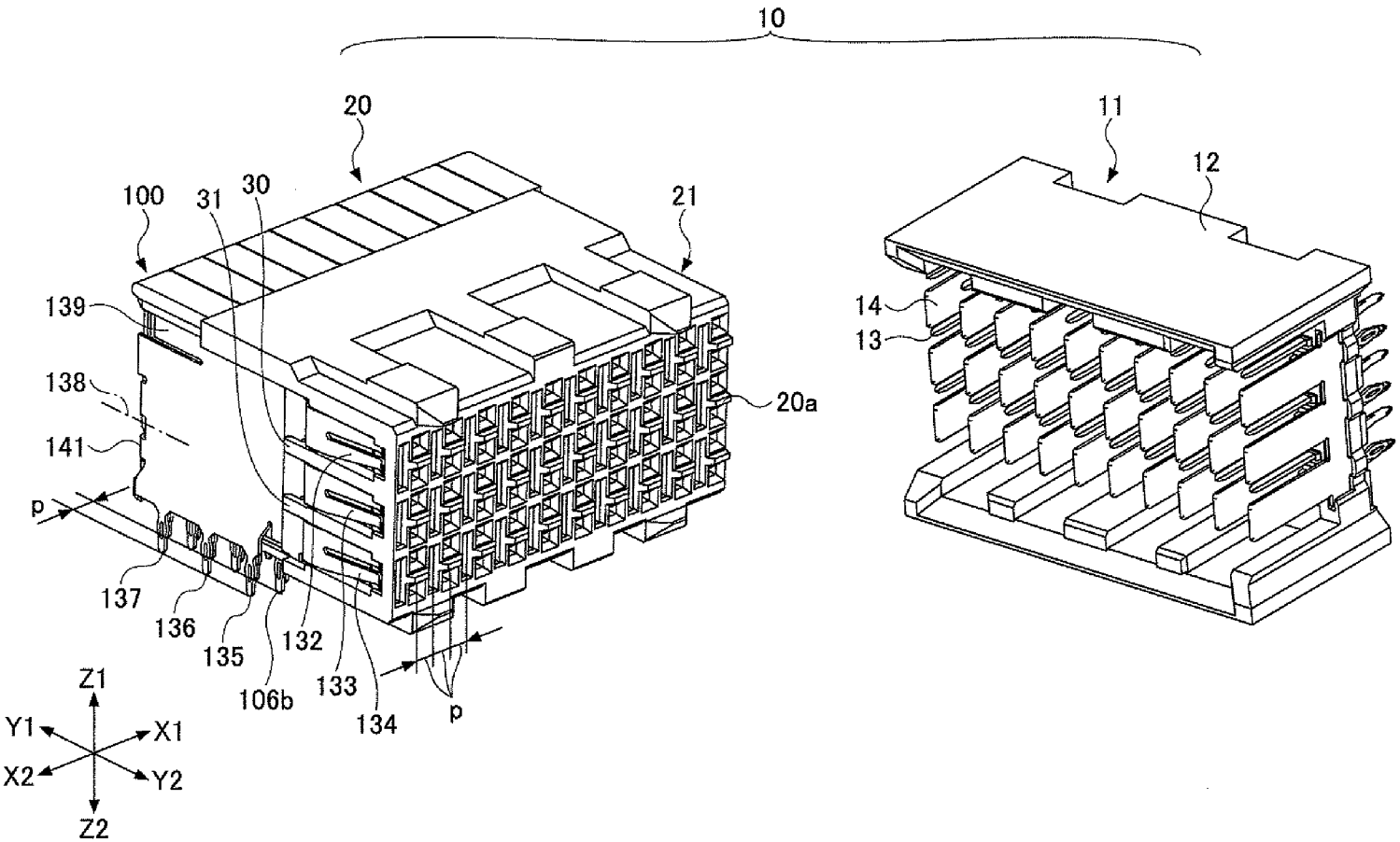
FIG. 1 is a perspective view of a jack connector and a plug connector according to a first embodiment of the present invention.
Figure 2:
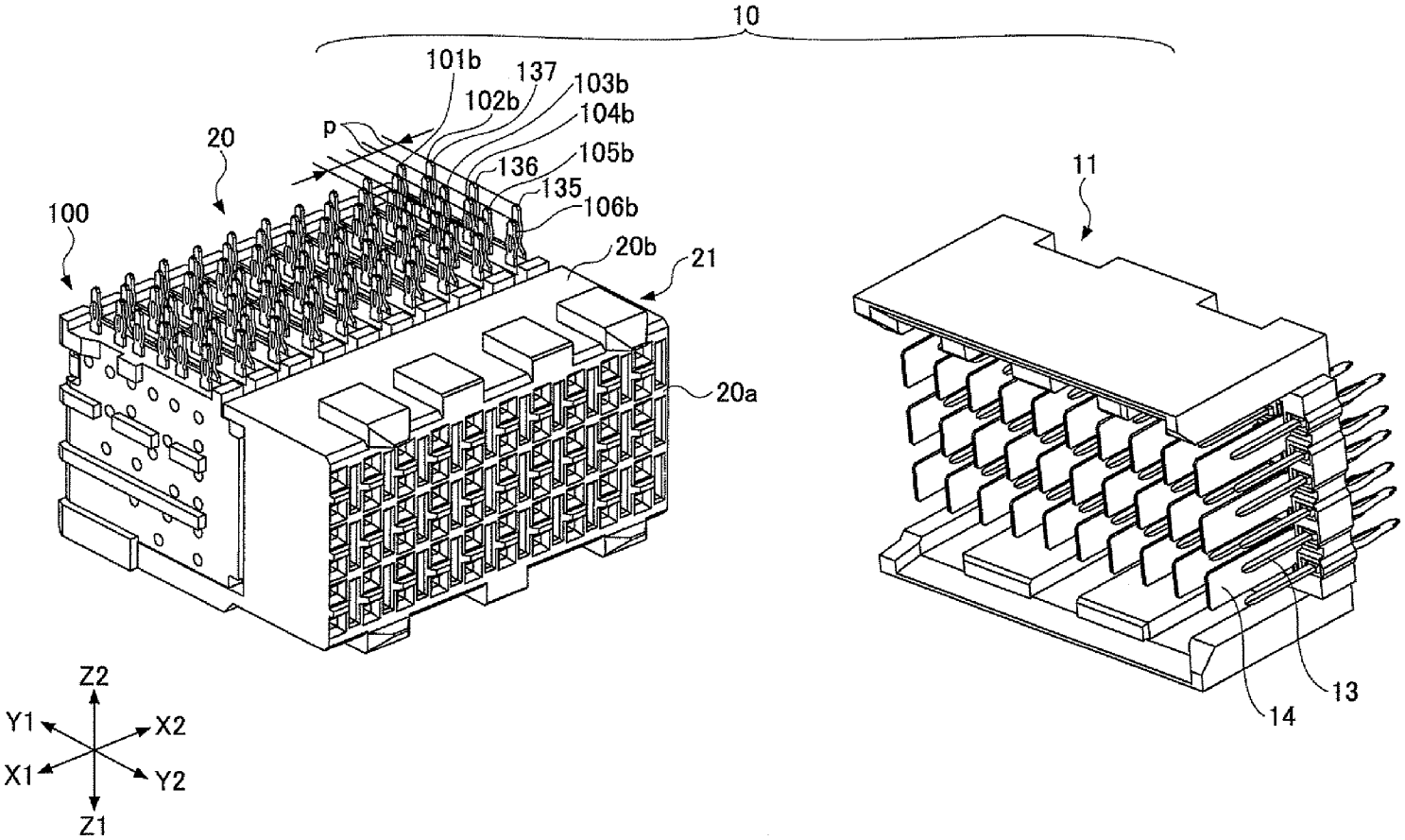
FIG. 2 is a perspective view of the jack connector and the plug connector illustrated in FIG. 1 viewing in an upside-down direction.

FIG. 1 is a perspective view illustrating a jack connector 20 according to a first embodiment together with a plug connector 11. FIG. 2 is a perspective view illustrating the jack connector 20 and the plug connector 11 positioned upside down. The jack connector 20 is a high-speed transmission jack connector for a daughter board. The jack connector 20 and the plug connector 11 together constitute a connector device 10. The jack connector 20 includes contact parts 101*a* through 106*a* (refer to FIG. 9) and shield parts 132 through 134 aligned in a matrix arrangement. The plug connector 11 includes a housing 12 in which pin contacts 13 and E-letter shaped shield members 14 are aligned in a matrix arrangement.

In the figures, X1-X2 indicates a longitudinal direction of the jack connector 20, Y1-Y2 indicates a direction of depth, and Z1-Z2 indicates a direction of height. The Y2 side is a front face side (front side) of the jack connector 20, and the Y1 side is a rear face side (rear side) of the jack connector 20. With respect to terminal parts, contact parts and arrangement of contact modules, the X1-X2 direction corresponds to an extending direction of rows and the Z1-Z2 direction corresponds to an extending direction of columns.

Figure 3:
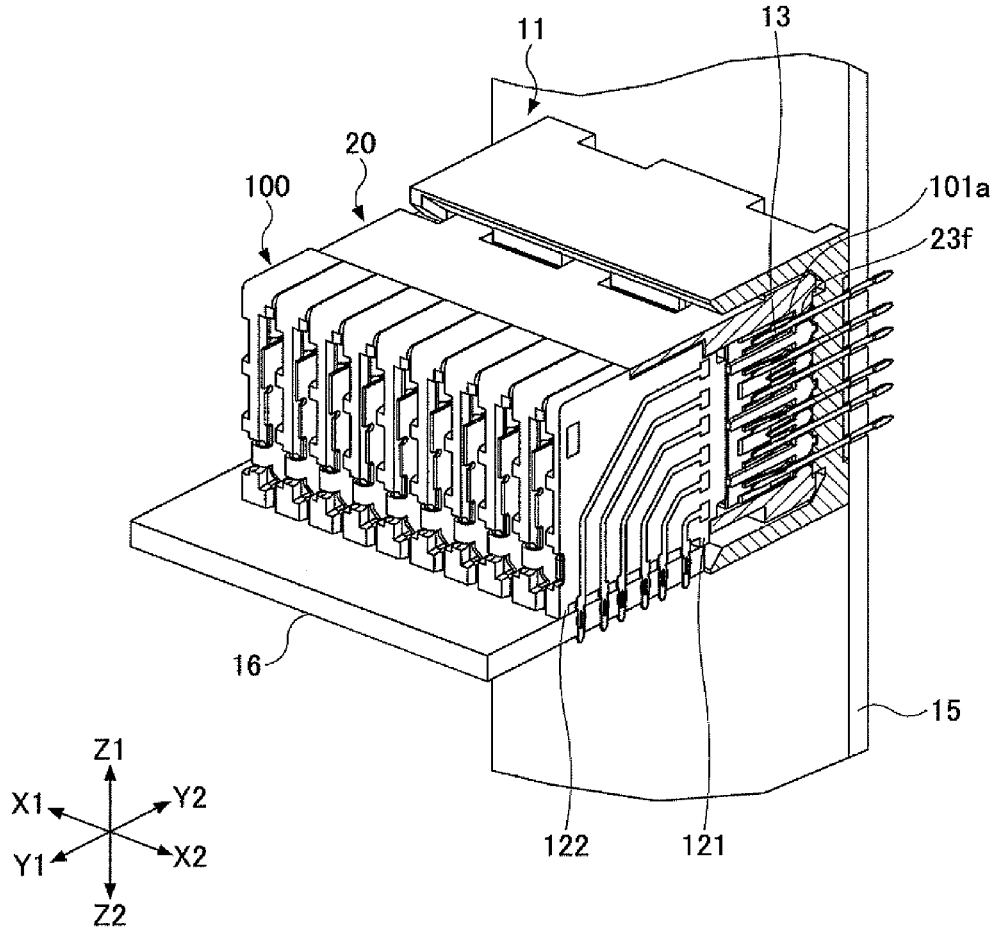
FIG. 3 is a perspective view of the jack connecter and the plug connector connected each other.

As illustrated in FIG. 3, the plug connector 11 is mounted to a backplane 15, and the jack connector 20 is mounted to a daughter board 16. The plug connector 11 and the jack connector 20 are connected with each other so that the daughter board 16 is electrically connected to the backplane 15. The pin contacts 13 of the plug connector 11 are inserted into openings 23*f* mentioned later, and the shield members 14 of the plug connector 11 are inserted into openings 27 mentioned later. The contact parts 101*a* though 106*a* of the jack connector 20 fit to the pin contacts 13 of the plug connector 11 so that the contact parts 101*a* through 106*a* are electrically and mechanically connected to the pin contacts 13. Additionally, the shield members 14 of the plug connector 11 are brought into contact with shield piece parts 132 through 134 mentioned later. According to the above-mentioned structure, the jack connector 20 is electrically and mechanically connected to the plug connector 11.

In practice, a plurality of jack connectors 11 are mounted to the backplane 15 in a state where the jack connectors 11 are arranged closely in the X1-X2 direction. Also a plurality of jack connectors 20 are mounted to one side of the daughter board 16 in a state where the jack connectors 20 are arranged closely in the X1-X2 direction.

Figure 4A:
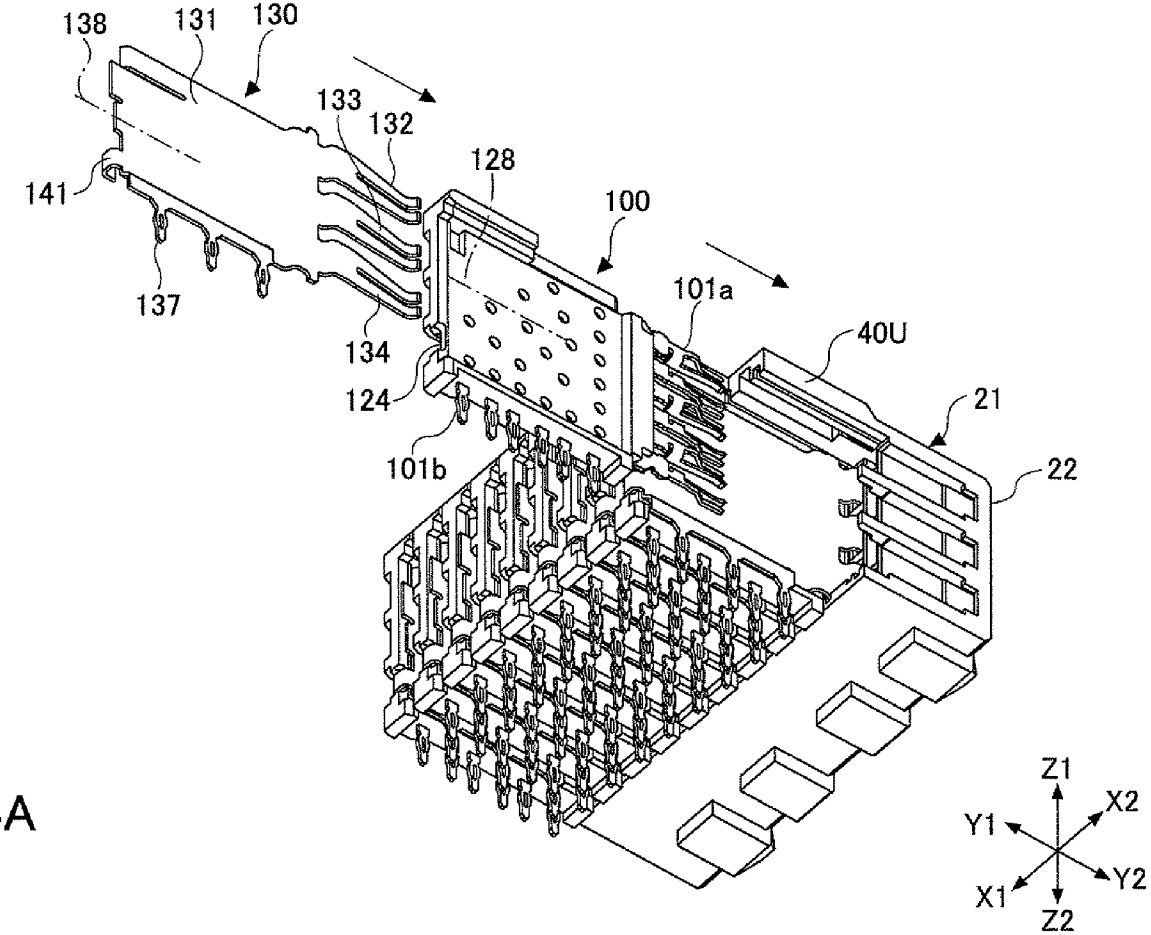
FIG. 4A is a perspective view of the jack connector with a contact module and a shield member to be connected to the jack connector.
Figure 4B:
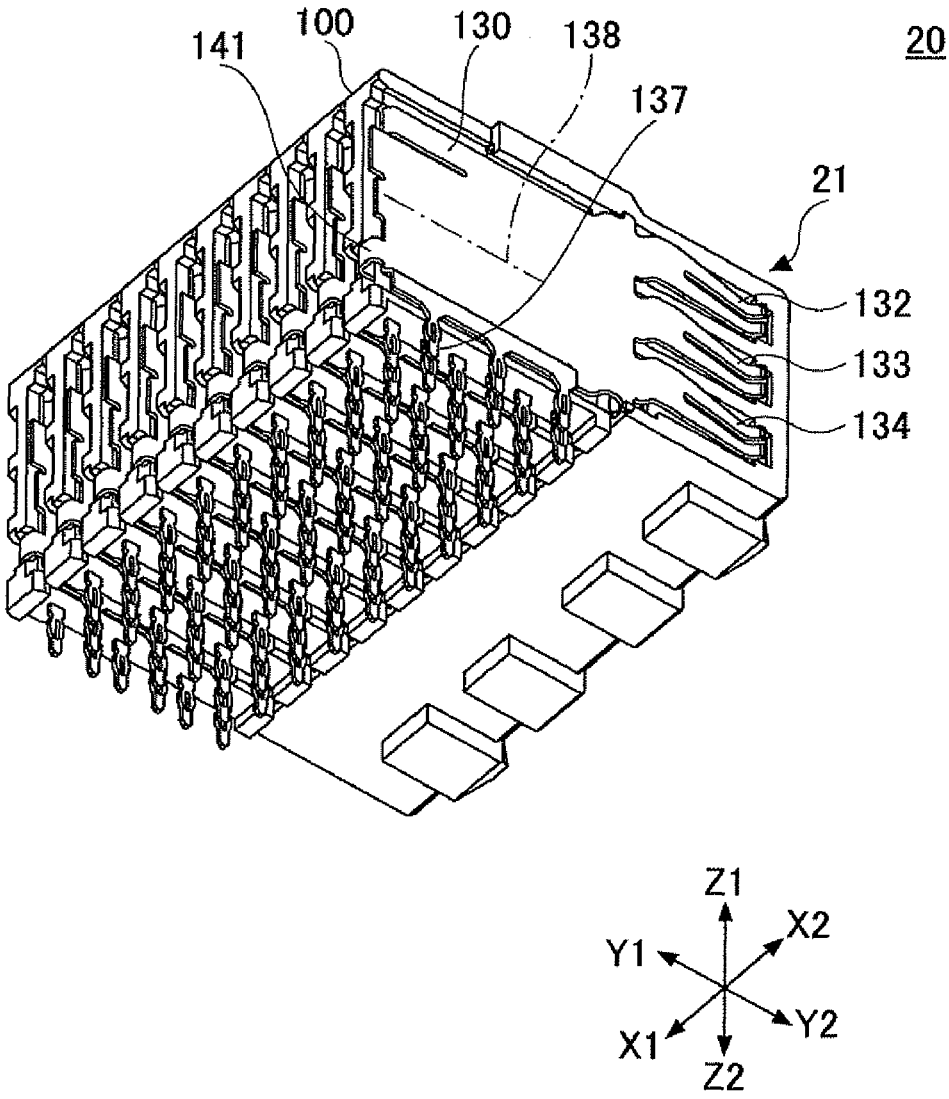
FIG. 4B is a perspective view of the jack connector with the contact module and the shield member connected to the jack connector.
Figure 5:
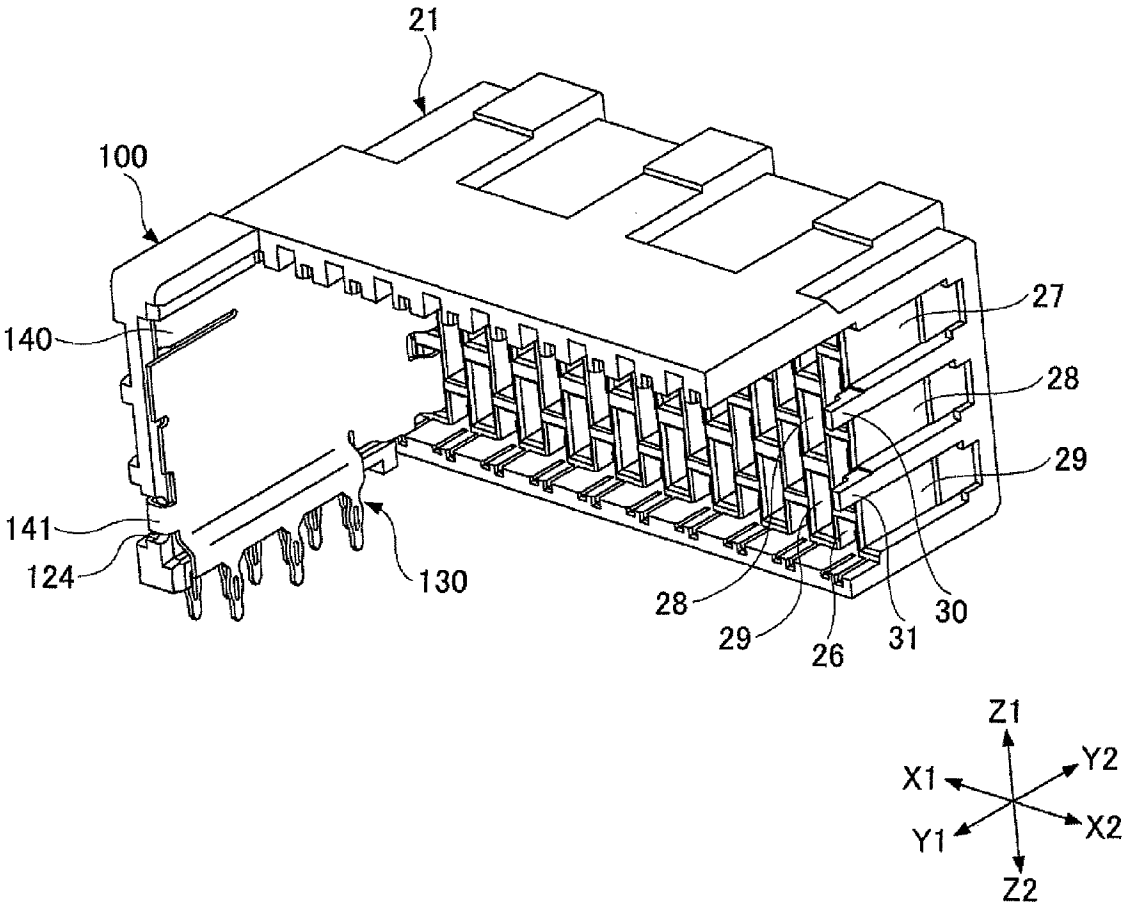
FIG. 5 is a perspective view of the jack connector with the contact module and the shield member connected to the jack connector viewed from a rear side.
Figure 6B:
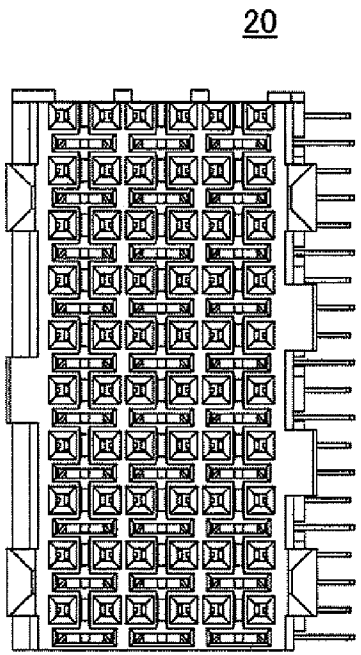
FIG. 6B is a front view of the jack connector.
Figure 6A:
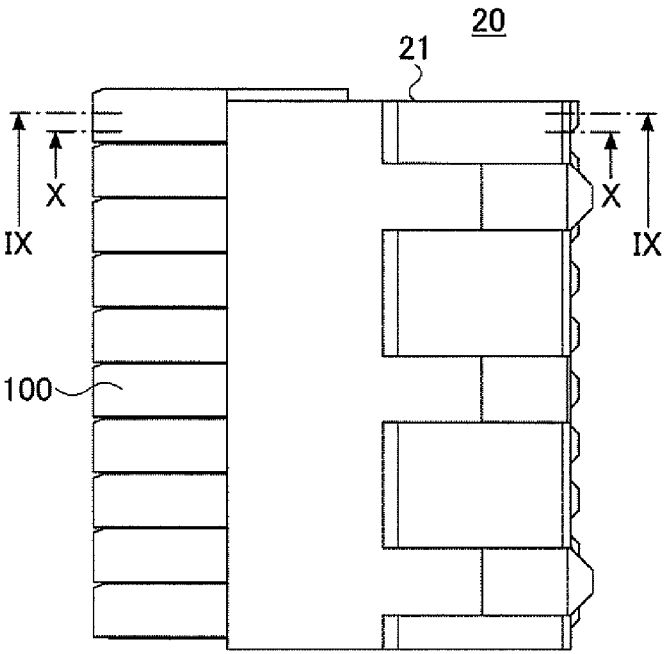
FIG. 6A is a plan view of the jack connector.
Figure 6C:
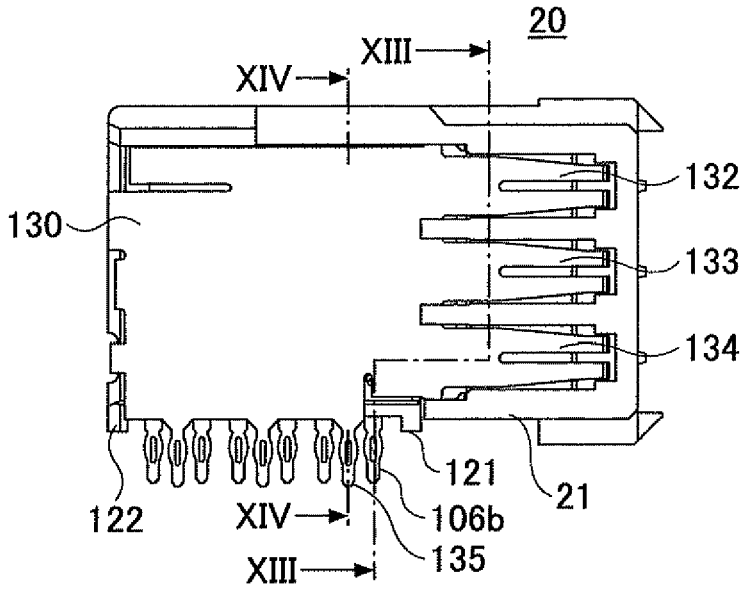
FIG. 6C is a side view of the jack connector on the X1 side.
Figure 6D:
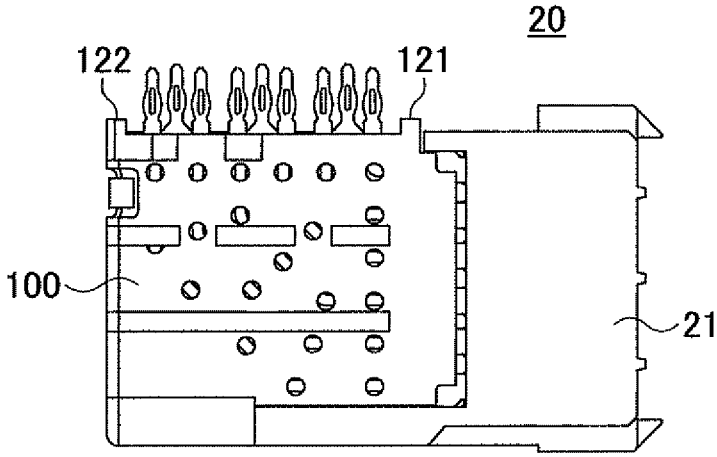
FIG. 6D is a side view of the jack connector on the X2 side.
Figure 7:
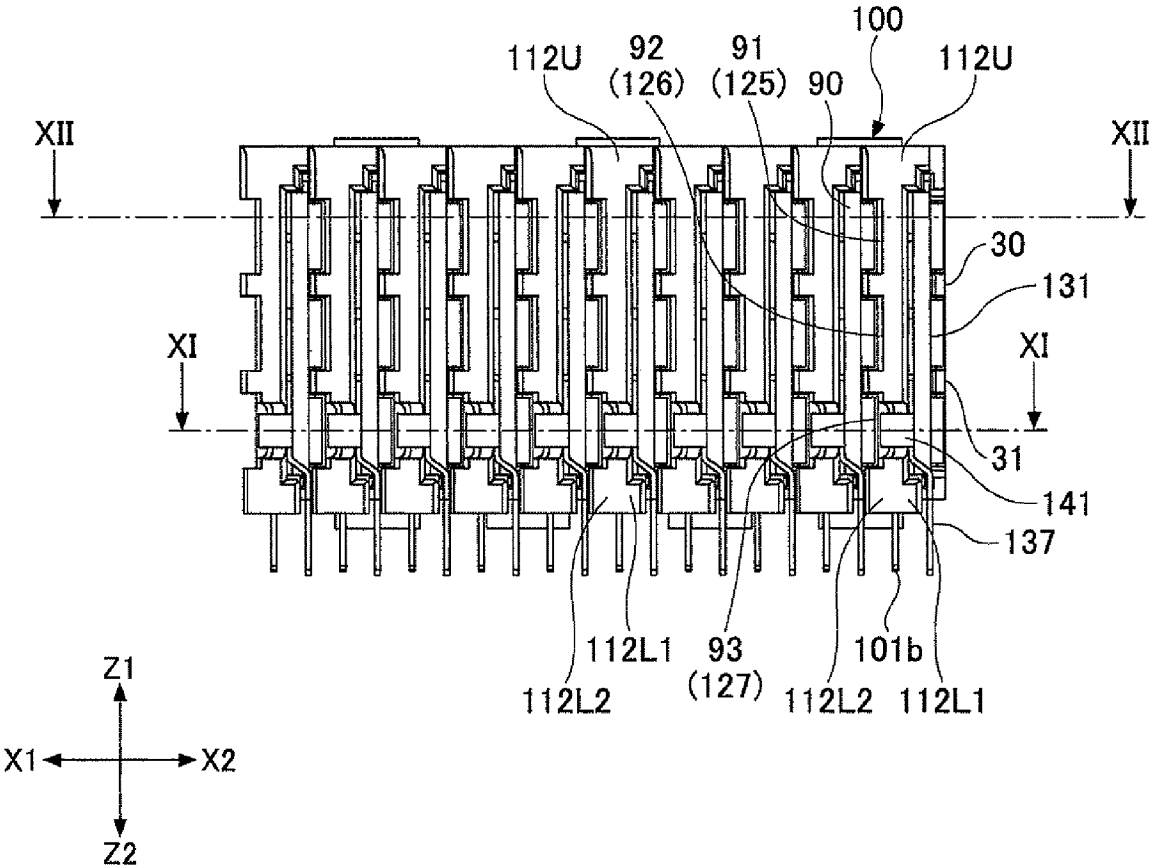
FIG. 7 is a rear view of the jack connector.
Figure 8:
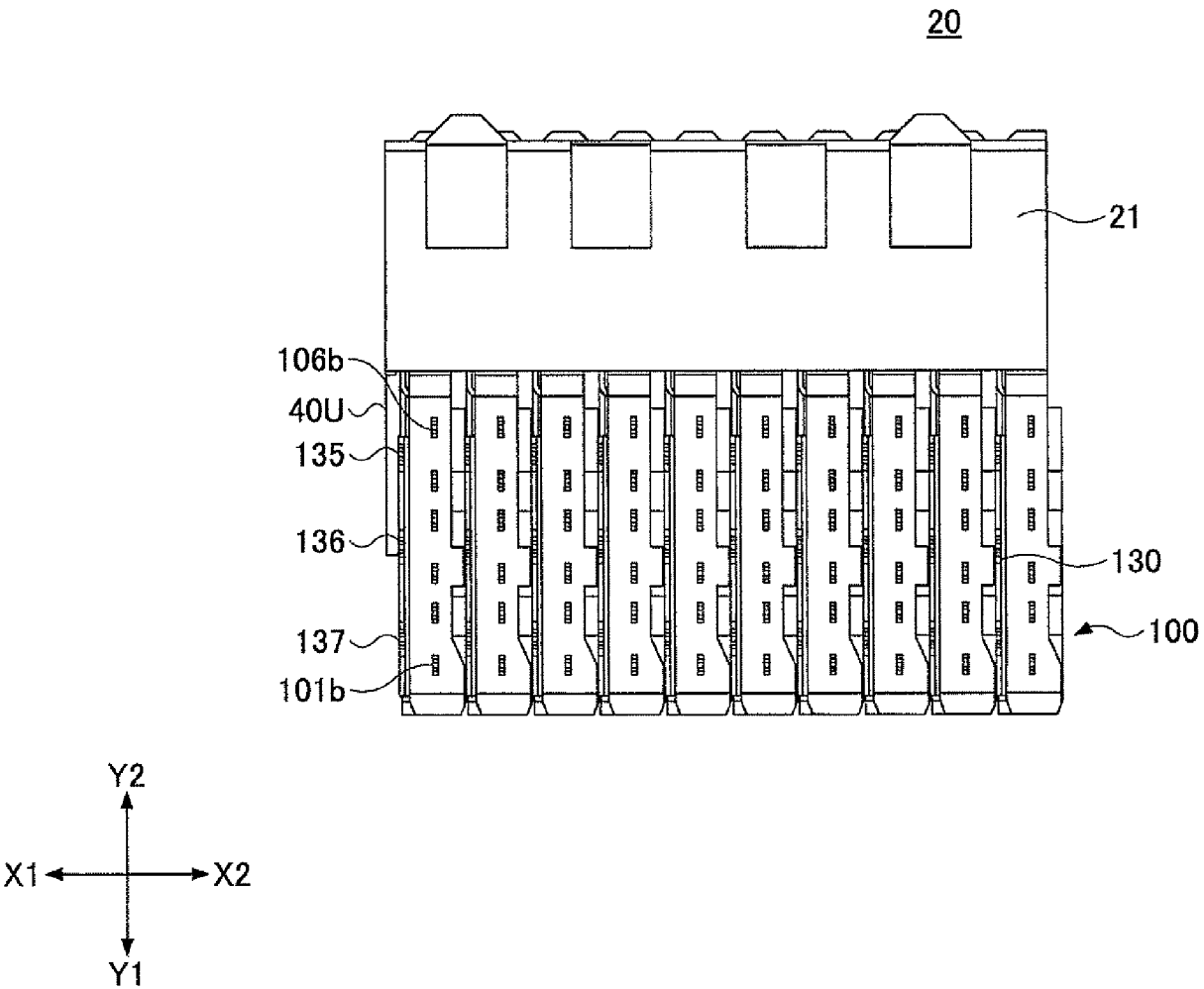
FIG. 8 is a bottom view of the jack connector.
Figure 9:
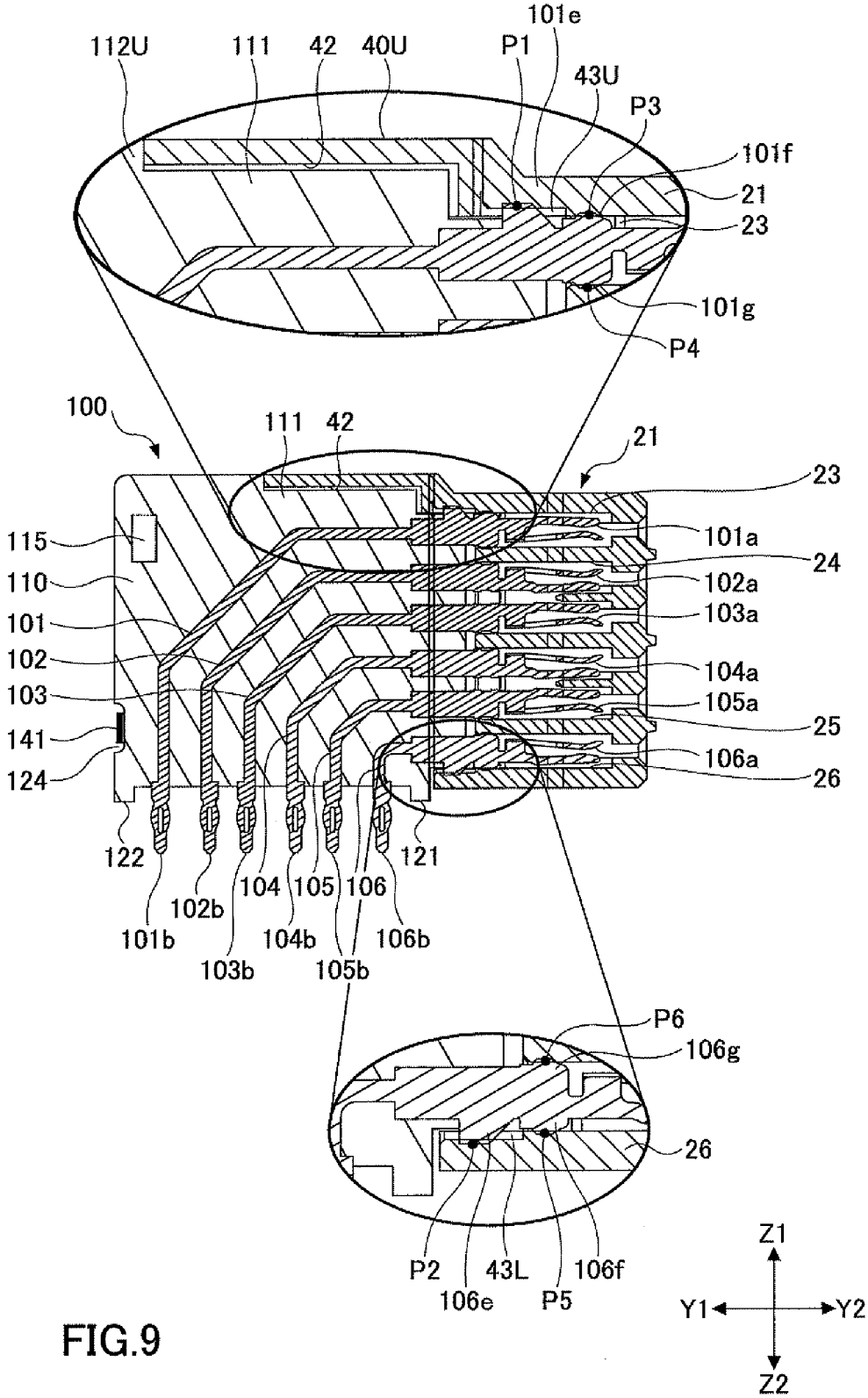
FIG. 9 is a cross-sectional view of the jack connector taken along a line IX-IX of FIG. 6A with enlarged views of portions thereof.
Figure 10:
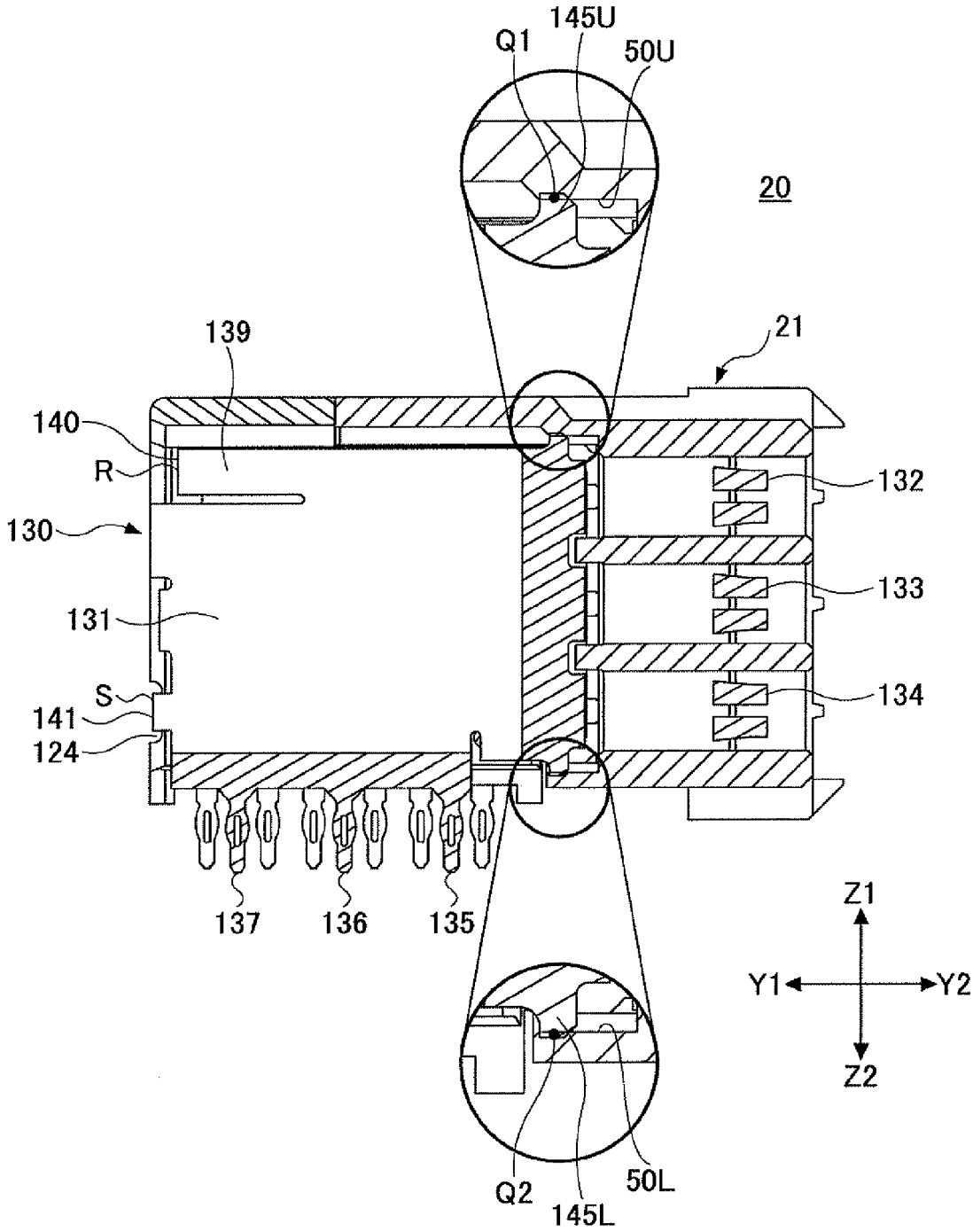
FIG. 10 is a cross-sectional view of the jack connector taken along a line X-X of FIG. 6A with enlarged views of portions thereof.
Figure 11:
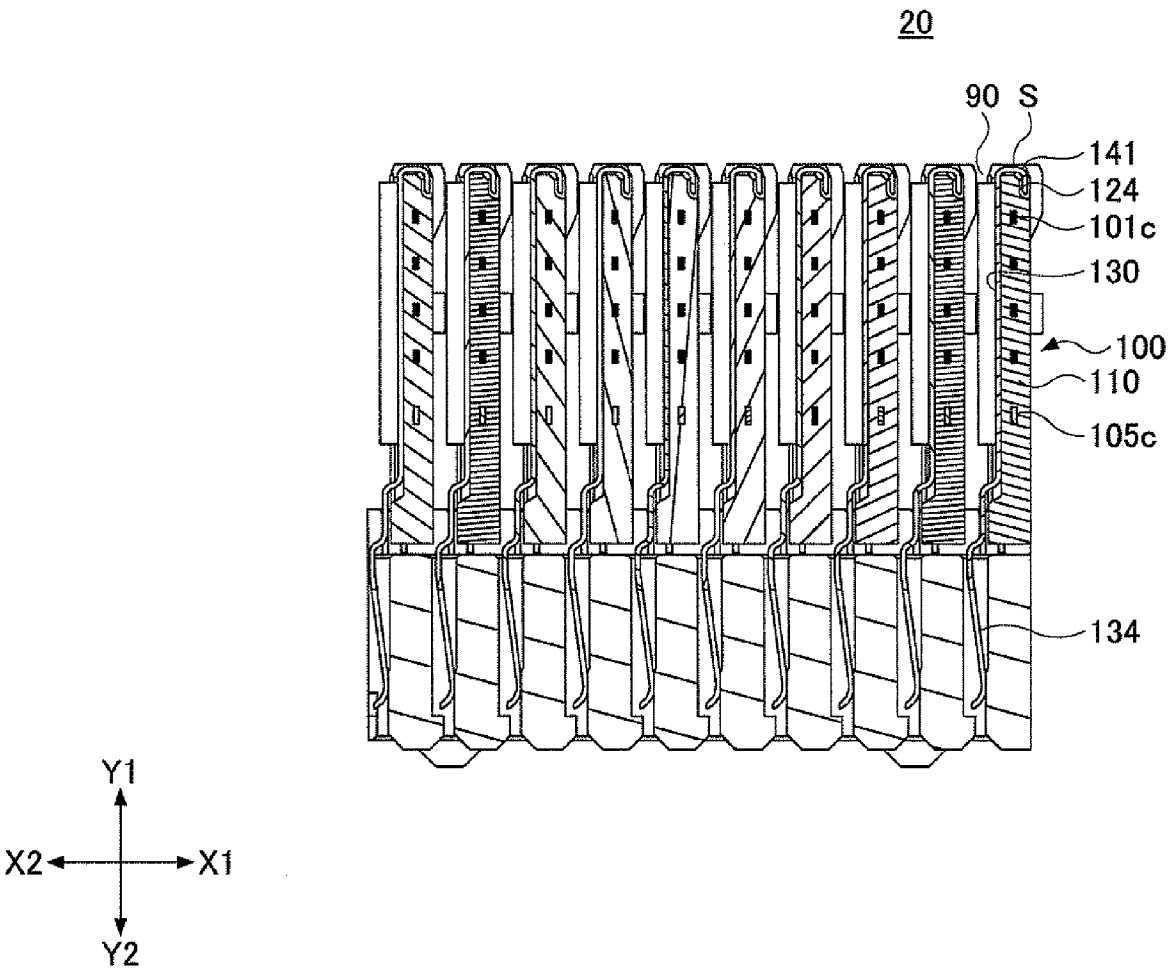
FIG. 11 is an enlarged cross-sectional view of the jack connector taken along a line XI-XI of FIG. 7.
Figure 12:
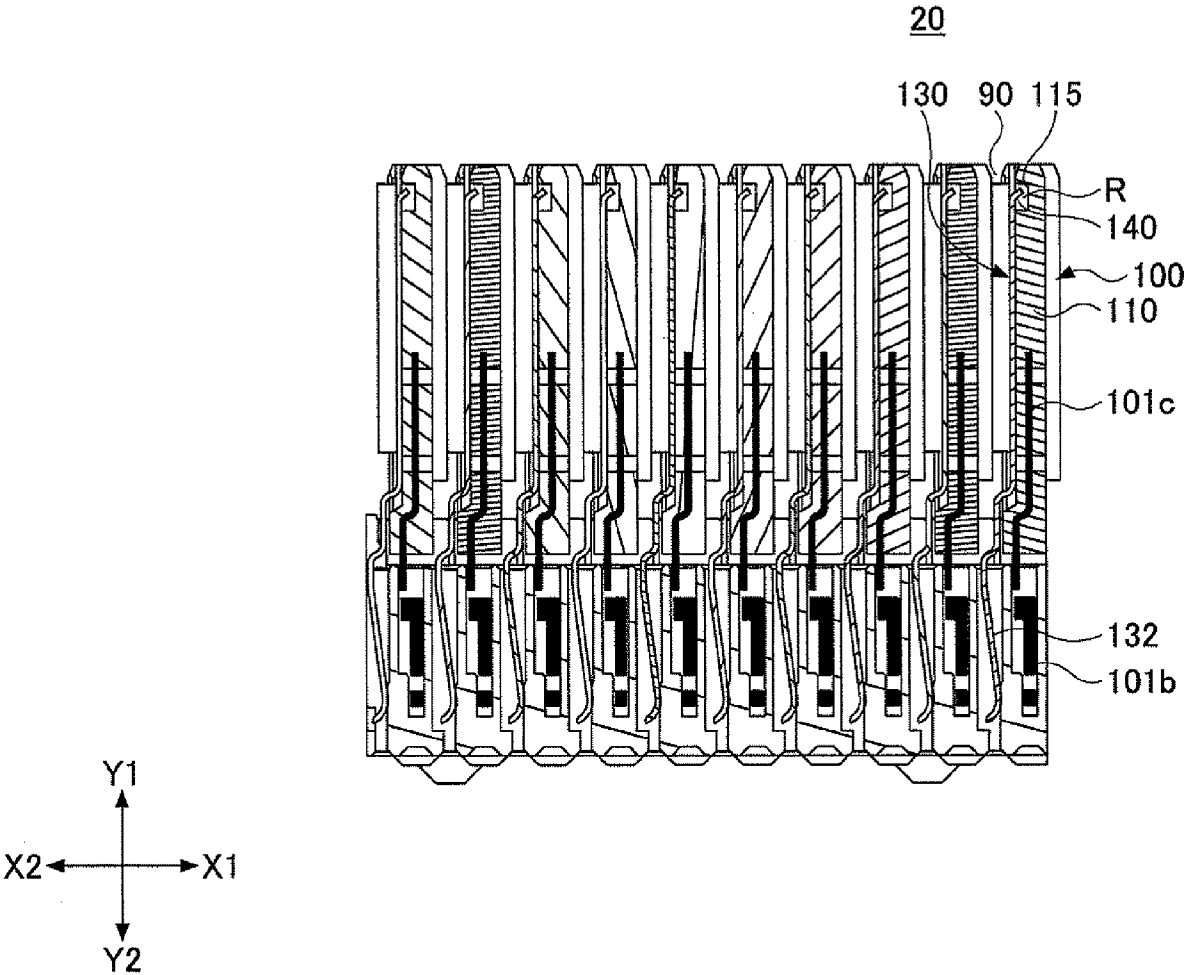
FIG. 12 is an enlarged cross-sectional view of the jack connector taken along a line XII-XII of FIG. 7.
Figure 13:
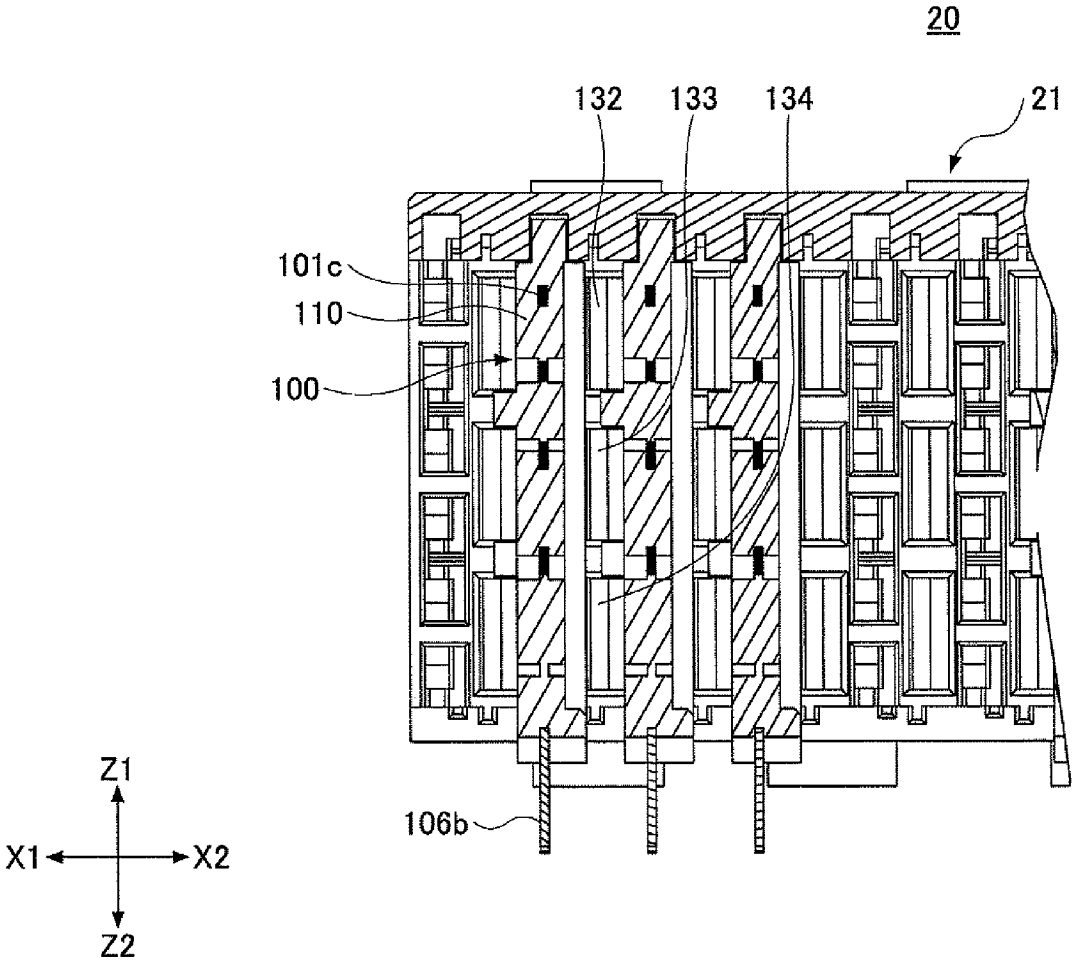
FIG. 13 is an enlarged cross-sectional view of the jack connector taken along a line XIII-XIII of FIG. 6C.
Figure 14:
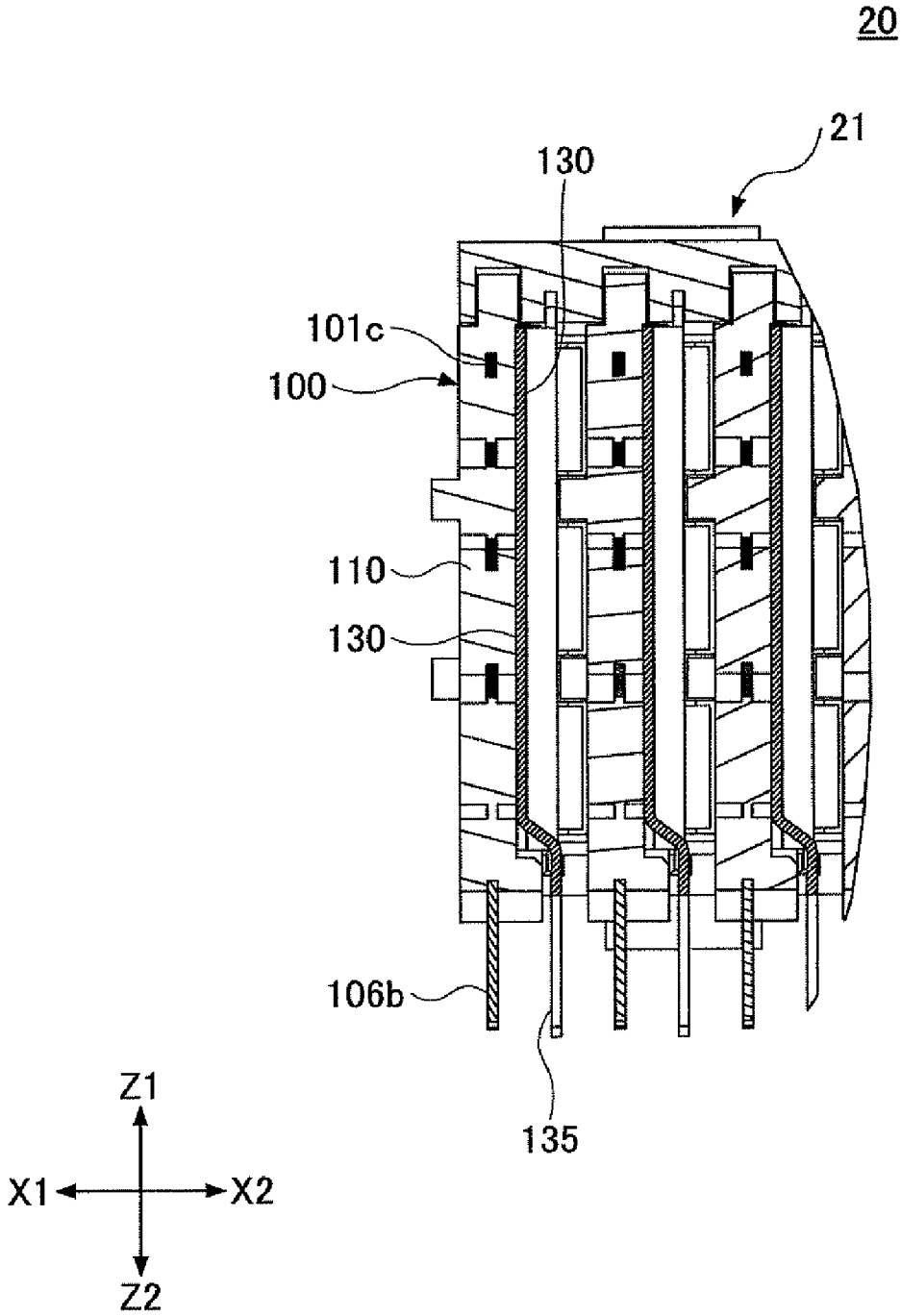
FIG. 14 is an enlarged cross-sectional view of the jack connector taken along a line XIV-XIV of FIG. 6C.

The jack connector 20 is illustrated in FIG. 4A through FIG. 14 in various directions. FIG. 4A is a perspective view of the jack connector 20 with a contact module 100 and a shield member 130 to be connected to the jack connector 20. FIG. 4B is a perspective view of the jack connector 20 with the contact module 100 and the shield member 130 that have been connected to the jack connector 20. FIG. 5 is a perspective view of the jack connector 20 to which one contact module 100 and one shield member 130 are connected to the jack connector 20 viewed from a rear side. FIG. 6A is a plan view of the jack connector 20. FIG. 6B is a front view of the jack connector 20. FIG. 6C is a side view of the jack connector 20 on the X1 side. FIG. 6D is a side view of the jack connector 20 on the X2 side. FIG. 7 is a rear view of the jack connector 20. FIG. 8 is a bottom view of the jack connector 20. FIG. 9 is a cross-sectional view of the jack connector 20 taken along a line IX-IX of FIG. 6A with enlarged views of portions thereof in a state where the contact module 100 is incorporated into a housing 21. FIG. 10 is a cross-sectional view of the jack connector 20 taken along a line X-X of FIG. 6A with enlarged views of portions thereof in a state where the shield member 130 is incorporated into the housing 21. FIG. 11 is an enlarged cross-sectional view of the jack connector 20 taken along a line XI-XI of FIG. 7 in a state where the contact module 100 and the shield member 130 are incorporated into the housing 21 in alignment. FIG. 12 is an enlarged cross-sectional view of the jack connector 20 taken along a line XII-XII of FIG. 7 in the state where a state where the contact module 100 and the shield member 130 are incorporated into the housing 21 in alignment. FIG. 13 is an enlarged cross-sectional view of the jack connector 20 taken along a line XIII-XIII of FIG. 6C in the state where the contact module 100 and the shield member 130 are incorporated into the housing 21 in alignment. FIG. 14 is an enlarged cross-sectional view of the jack connector 20 taken along a line XIV-XIV of FIG. 6C in the state where the contact module 100 and the shield member 130 are incorporated into the housing in alignment.

A plurality of contact modules 100 and a plurality of shield members 130 are inserted into the housing 21 of the jack connector 20. The contact modules 100 and the shield members 130 are alternately arranged in a longitudinal direction so that the rear end surfaces of the contact modules 100 are aligned in a line.

As illustrated in FIG. 1, with respect to a surface 20*a* of the jack connector 20 which surface is on a side connected to the plug connector 11 from among surfaces of the jack connector 20, the contact parts 101*a* through 106*a* of the contact modules 100 (refer to FIG. 9) and the shield piece parts 132 through 134 of the shield members 130 are positioned by being accommodated in small segmented spaces arranged in the Z1-Z2 direction and the X1-X2 direction. In the X1-X2 direction, the contact parts 101*a* through 106*a* of the contact modules 100 and the shield piece parts 132 through 134 of the shield member 130 are arranged at a predetermined pitch p. In FIG. 1, for the sake of convenience of illustration, the arrangement of the contact parts 101*a* through 106*a* and the shield piece parts 132 through 134 is illustrated as an arrangement of the openings of the small segmented spaces in the surface 20*a* of the housing 21.

As illustrated in FIG. 1 and FIG. 2, with respect to a surface 2*b* of the jack connector 20 on the side mounted to the daughter board 16 from among surfaces of the jack connector 20, the mounting terminal parts 101*b* through 106*b* of the contact modules 100 and the mounting terminal pars 125 through 127 of the shield members 130 are arranged in the Y1-Y2 direction and the X1-X2 direction. In the X1-X2 direction, the mounting terminal parts 101*b* through 106*b* of the contact modules 100 and the mounting terminal parts 125 through 127 of the shield members 130 are arranged at the same pitch as the above-mentioned pitch p.

Each of the jack connector 20, the contact module 100 and the shield member 130 can be imaginarily divided into two portions, which are an upper side portion and a lower side portion. Hereinafter, parts contained in the upper side portion are given reference numbers with a suffix "U" and parts contained in the lower side portion are given reference numbers with a suffix "L".

Fixation of the contact module 100 and the shield member 130 to the housing 21 will be explained in detail later.

Figure 15:
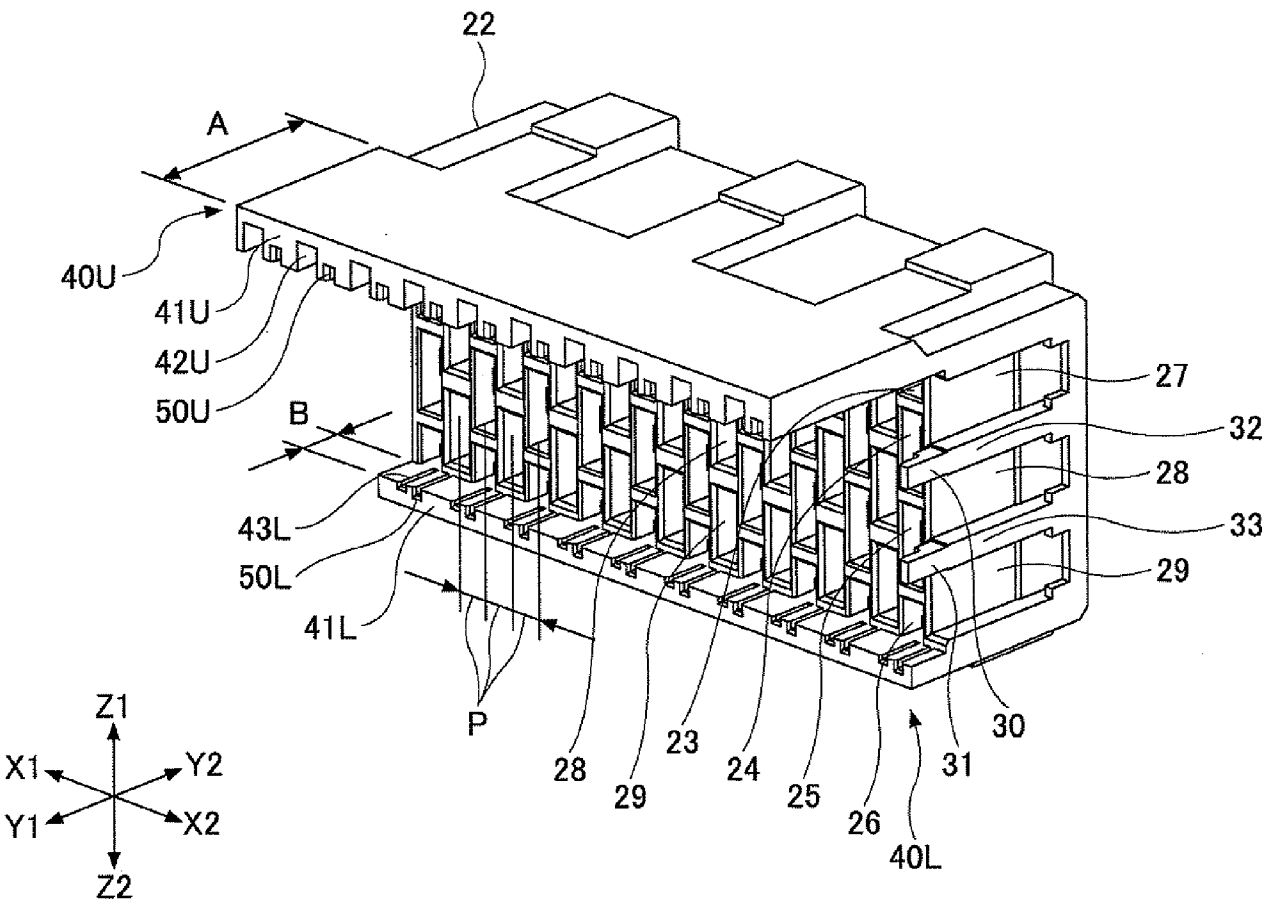
FIG. 15 is a perspective view of a housing of the jack connector.
Figure 16:
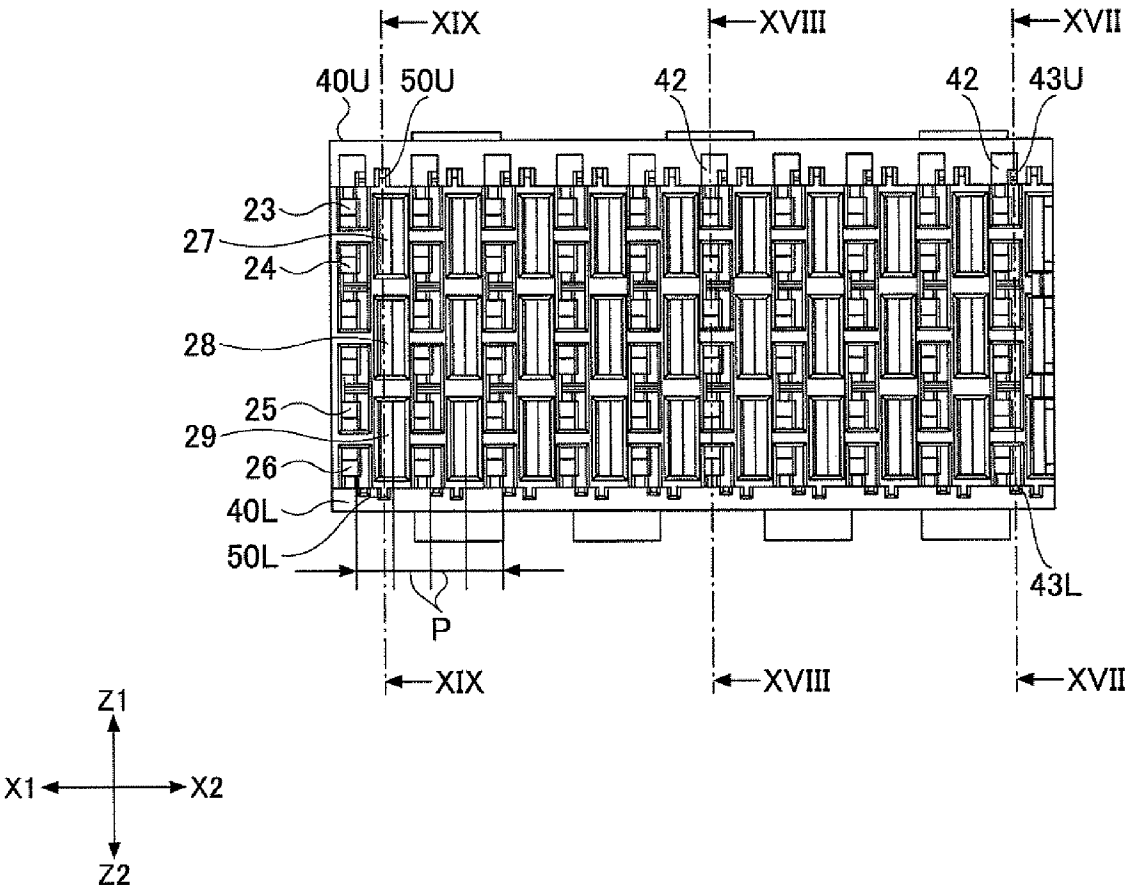
FIG. 16 is a rear view of the housing.
Figure 17:
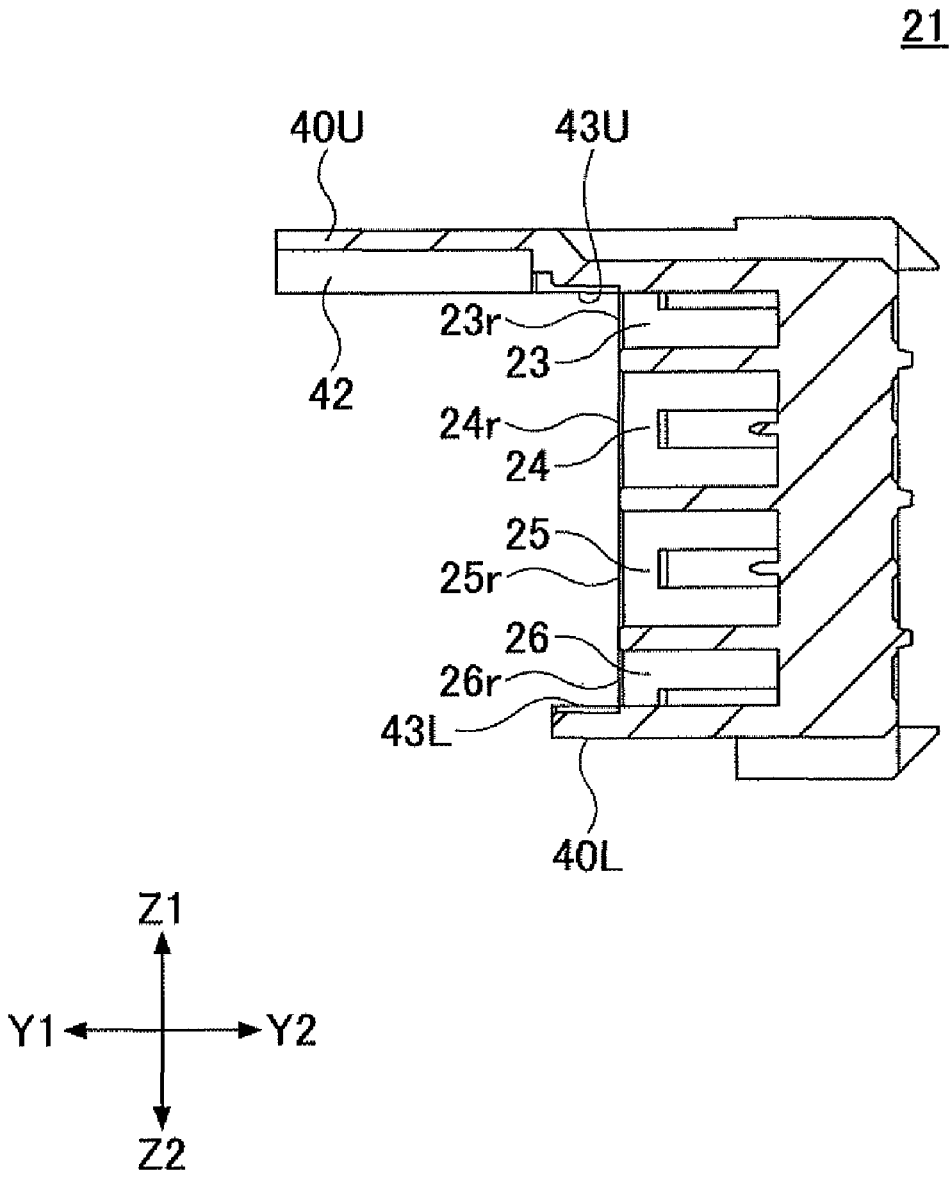
FIG. 17 is an enlarged cross-sectional view of the housing taken along a line XVII-XVII of FIG. 16.
Figure 18:
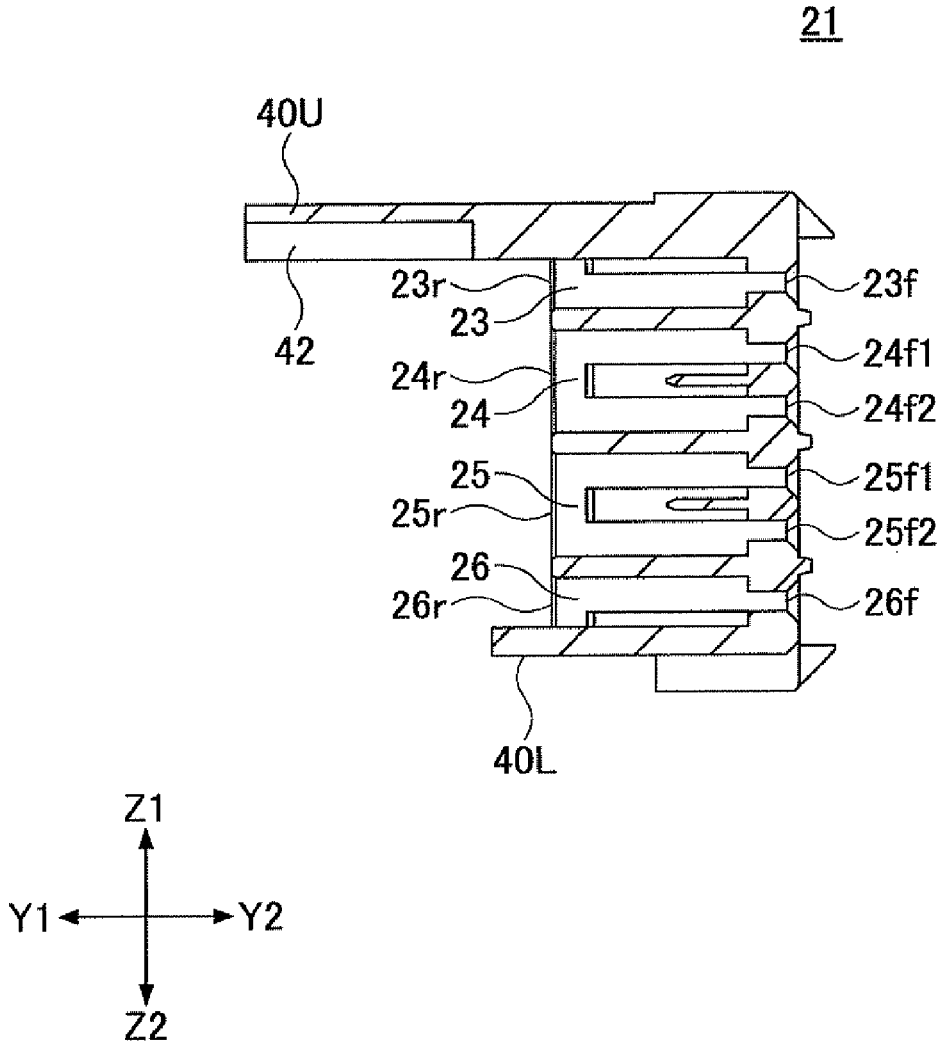
FIG. 18 is an enlarged cross-sectional view of the housing taken along a line XVIII-XVIII of FIG. 16.
Figure 19:
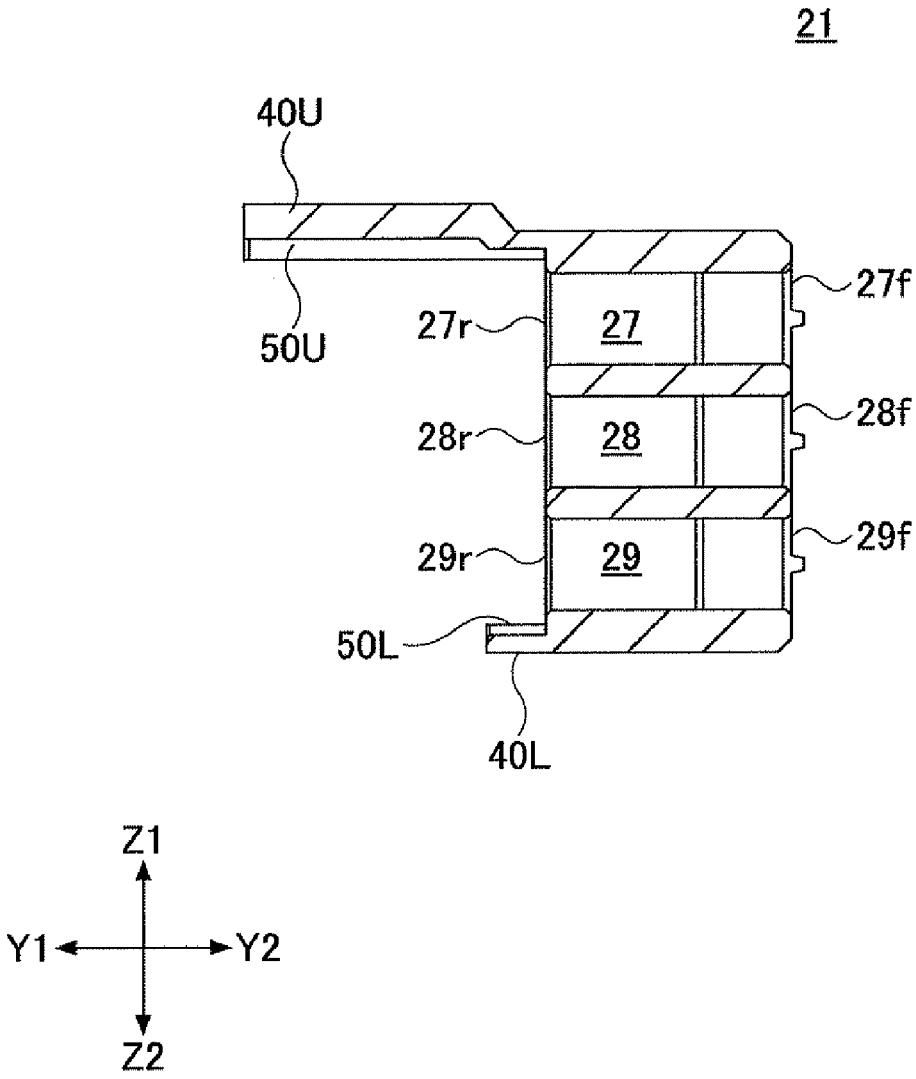
FIG. 19 is an enlarged cross-sectional view of the housing taken along a line XIV-XIV of FIG. 16.
Figure 20:
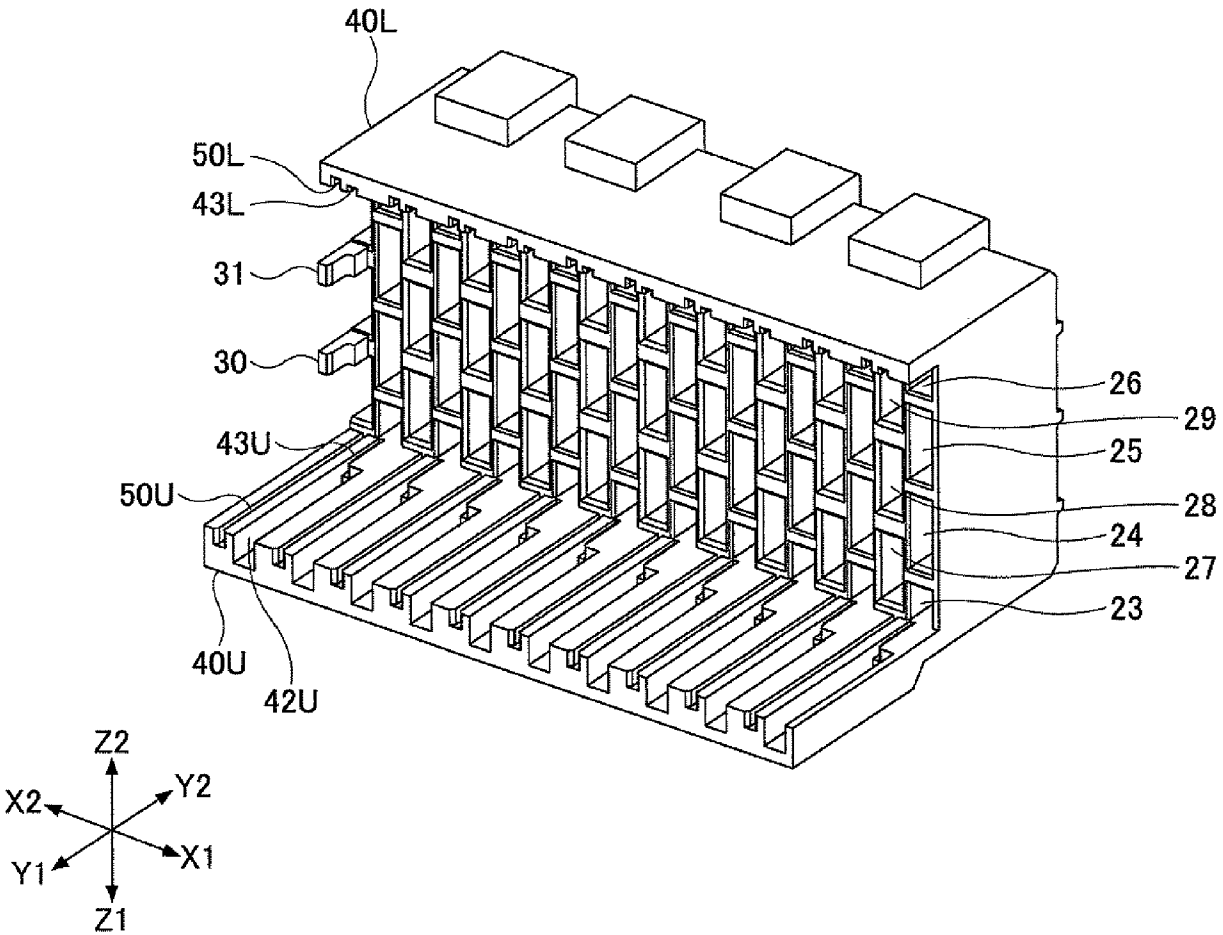
FIG. 20 is a perspective view of the housing viewed from the rear side.
Figure 21:
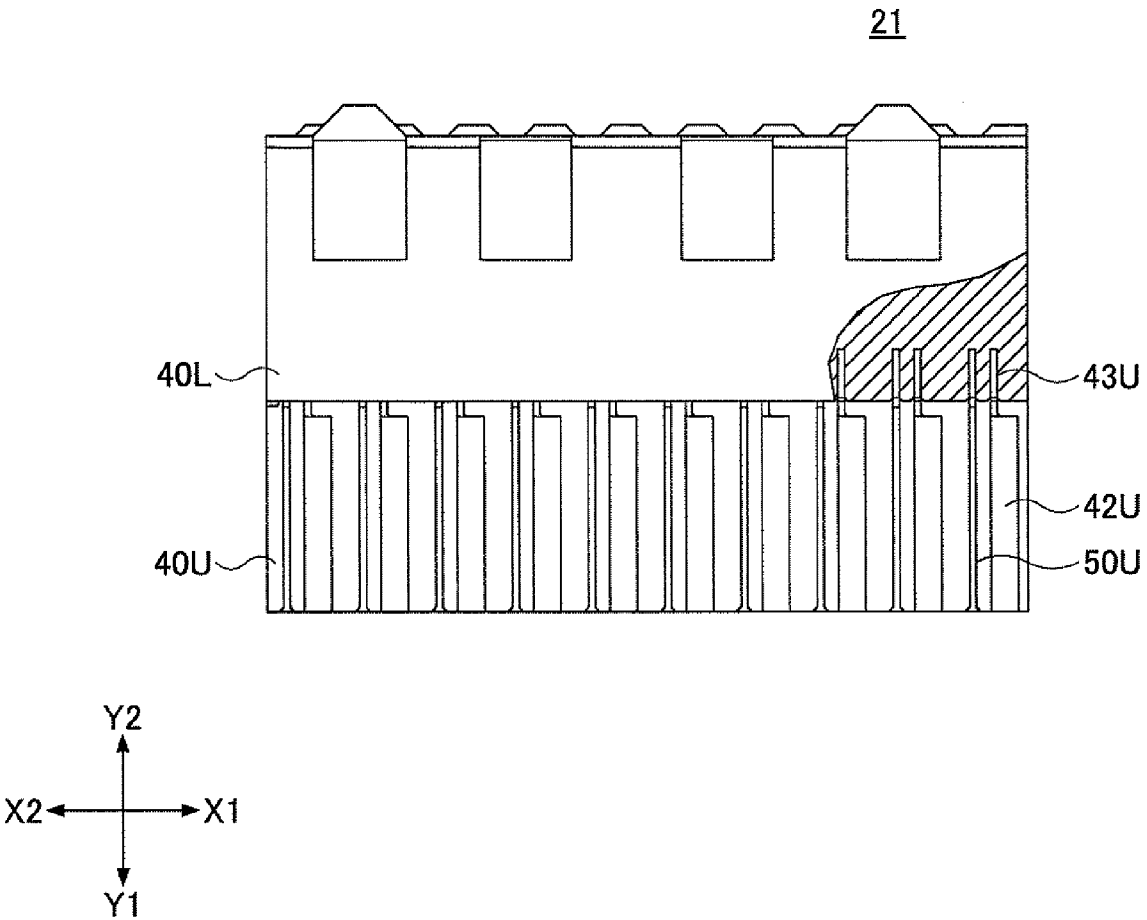
FIG. 21 is a partly cut-away plan view of the housing.

A description will be given below, with reference to FIGS. 16 through 21, of the housing 21 of the jack connector 20. FIG. 15 is a perspective view of the housing 20 viewed from the rear side. FIG. 16 is a rear view of the housing 21 viewed from the Y1 side. FIG. 17 is an enlarged cross-sectional view of the housing 21 taken along a line XVII-XVII of FIG. 16. FIG. 18 is an enlarged cross-sectional view of the housing 21 taken along a line XVIII-XVIII of FIG. 16. FIG. 19 is an enlarged cross-sectional view of the housing 21 taken along a line XIV-XIV of FIG. 16. FIG. 20 is a perspective view of the housing 21 viewed from the rear side by turning the housing 21 upside down. FIG. 21 is a partly cut-away plan view of the housing 21 viewed from the Z2 side.

The housing 21 is a plastic mold component having an electrically insulating function, and having a body 22 on the front side and protruding parts 40U and 40L on the rear side.

The body 22 of the housing 21 has a generally rectangular parallelepiped shape. In the body 22, contact part rooms 23 through 26 for accommodating the contact parts 101*a* through 106*a* and shield piece part rooms 27 through 29 for accommodating the shield piece parts 132 through 134 are arranged regularly. The four contact part rooms (23, 24, 25, 26) and the three shield piece part rooms (27, 28, 29) are aligned in the Z1-Z2 direction. With respect to the X1-X2 direction, the contact part rooms 23 through 26 and the shield piece part rooms 27 through 29 are alternately arranged at the above-mentioned pitch p. As illustrated in FIG. 18, the contact part room 23 has an opening 23*f* on the front side and an opening 23*r* on the rear side. The contact part room 24 has two openings 24*f*1 and 24*f*2 on the front side and an opening 24*r* on the rear side. Similarly, the contact part room 25 has two openings 25*f*1 and 25*f*2 on the front side and an opening 25*r* on the rear side. The contact part room 26 has an opening 26*f* on the front side and an opening 26*r* on the rear side. As illustrated in FIG. 19, the shield piece part room 27 has an opening 27*f* on the front side and an opening 27*r* on the rear side. The shield piece part room 28 has an opening 28*f* on the front side and an opening 28*r* on the rear side. The shield piece part room 29 has an opening 29*f* on the front side and an opening 29*r* on the rear side.

As illustrated in FIG. 15 and FIG. 20, shield member press parts 30 and 31 are formed on a side surface of the housing 21 on the X1 side. The shield member press parts 30 and 31 are finger-shaped parts of rib parts 32 and 33 extending in the Y1 direction, the rib parts 32 and 33 being provided to partition the shield piece part rooms 27, 28 and 29.

As illustrated in FIG. 15, each of the protruding parts 40U on the Z1 side and the protruding part 40L on the Z2 side has a rectangular plate shape. The protruding dimension A of the protruding part 40U in the Y1 direction is as long as about three times the protruding dimension B of the protruding part 40L. Each of the end surfaces 41U and 41L of the protruding parts 40U and 40L is a flat surface. Thus, a mold for the housing 21 can be fabricated relatively easily.

Contact module upper side guide grooves 42U and shield part upper side grooves 500 are formed in the bottom surface of the protruding part 40U alternately to extend in the Y1-Y2 direction. As illustrated in FIG. 20, guide grooves 430 for bulge parts 101*e* mentioned later extend from the closed ends of the contact module upper side guide grooves 42. Similarly, guide grooves 43L for bulge parts 106*e* mentioned later and shield part lower side guide grooves 50L are formed alternately on the top surface of the protruding part 40L on the Z1 side to extend in the Y1-Y2 direction. Each pair of the guide grooves 43U and 43L are located in the same Z plane, and each pair of the guide grooves 50U and 50L are located in the same Z plane but different from the Z plane in which the guide grooves 430 and 43L are located.

A description will be given below, with reference to FIG. 22 through FIG. 26, of a structure of the contact module 100.

Figure 22:
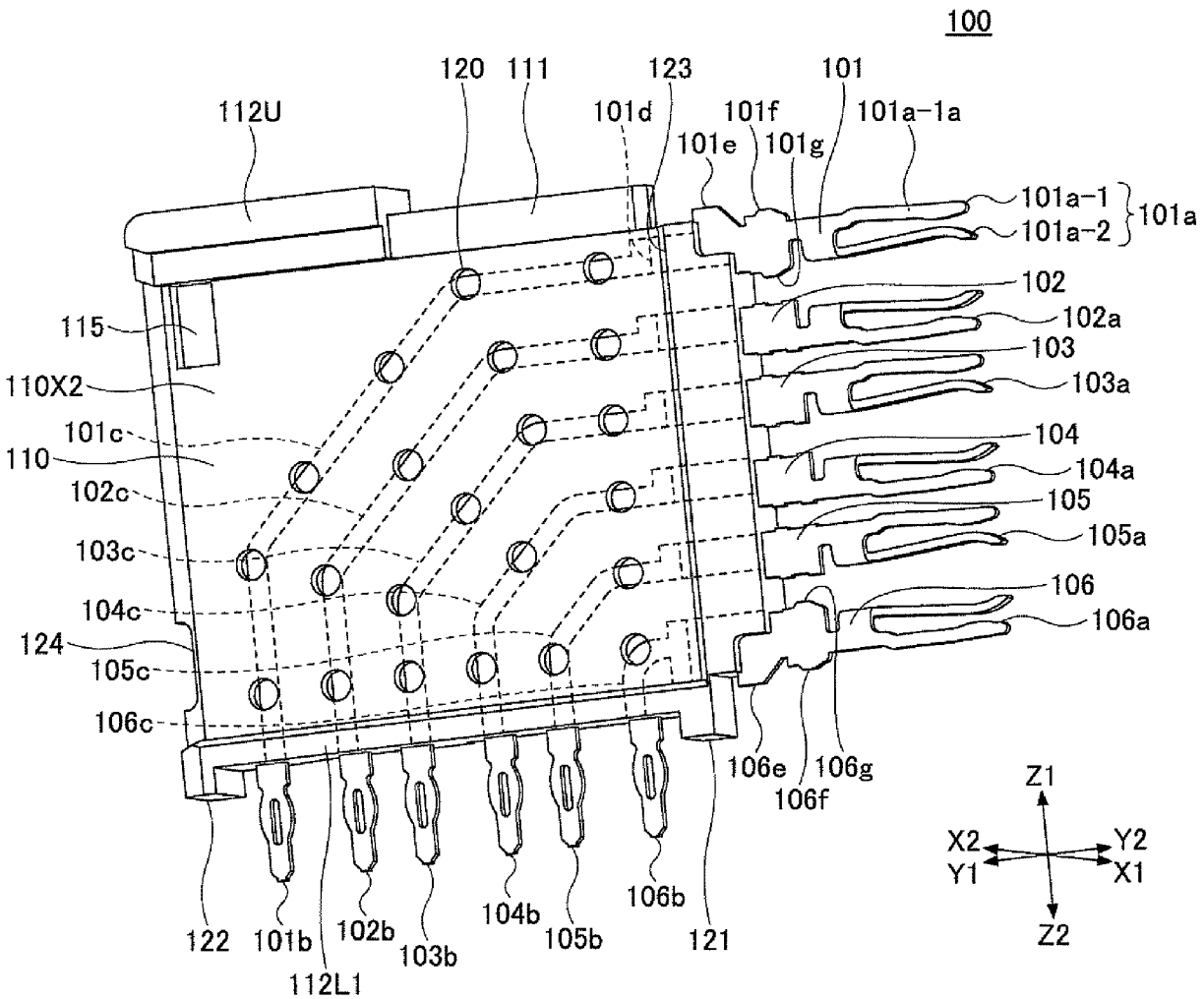
FIG. 22 is a perspective view of a contact module.
Figure 23:
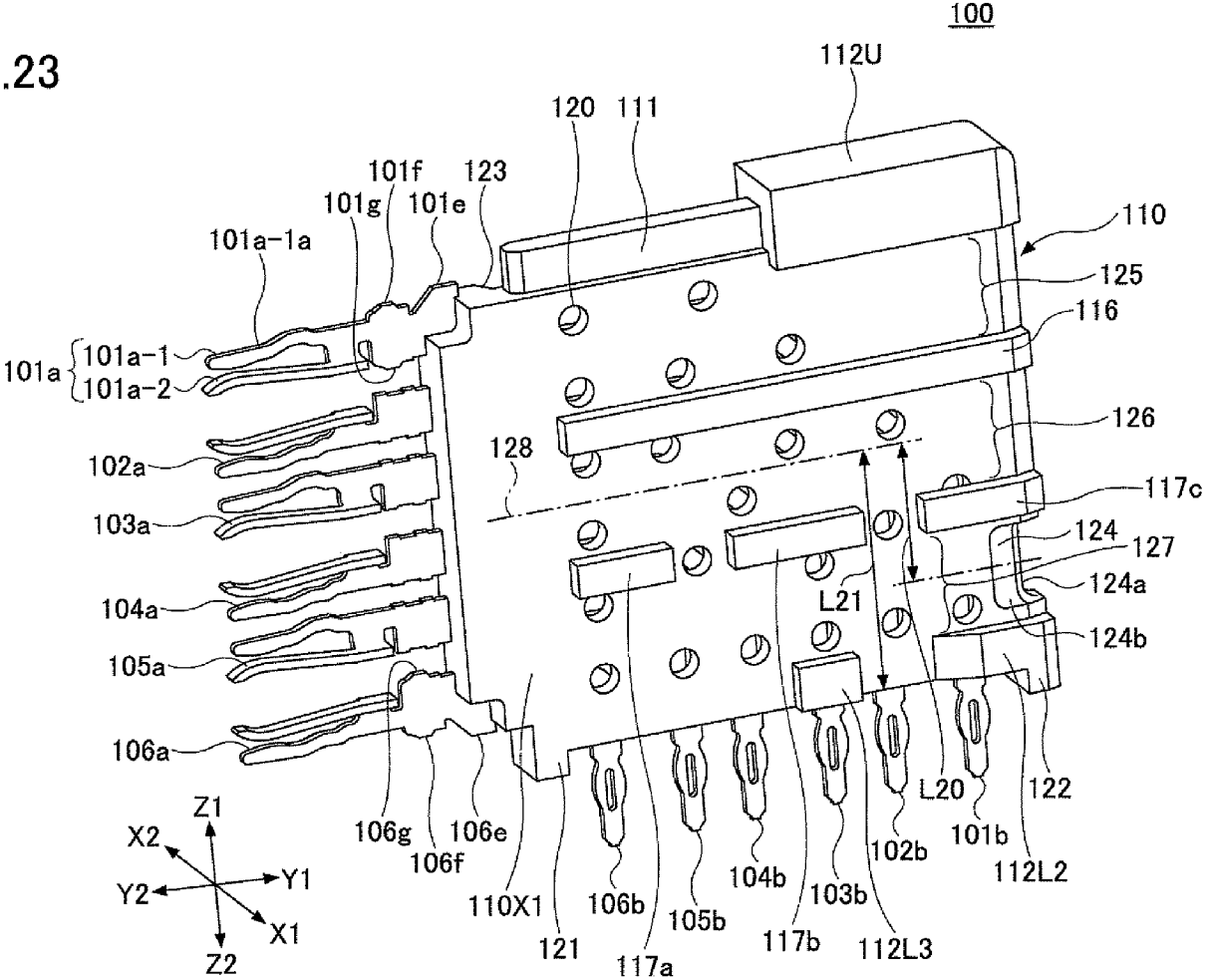
FIG. 23 is a perspective view of the contact module viewed from a different direction.
Figure 24A:
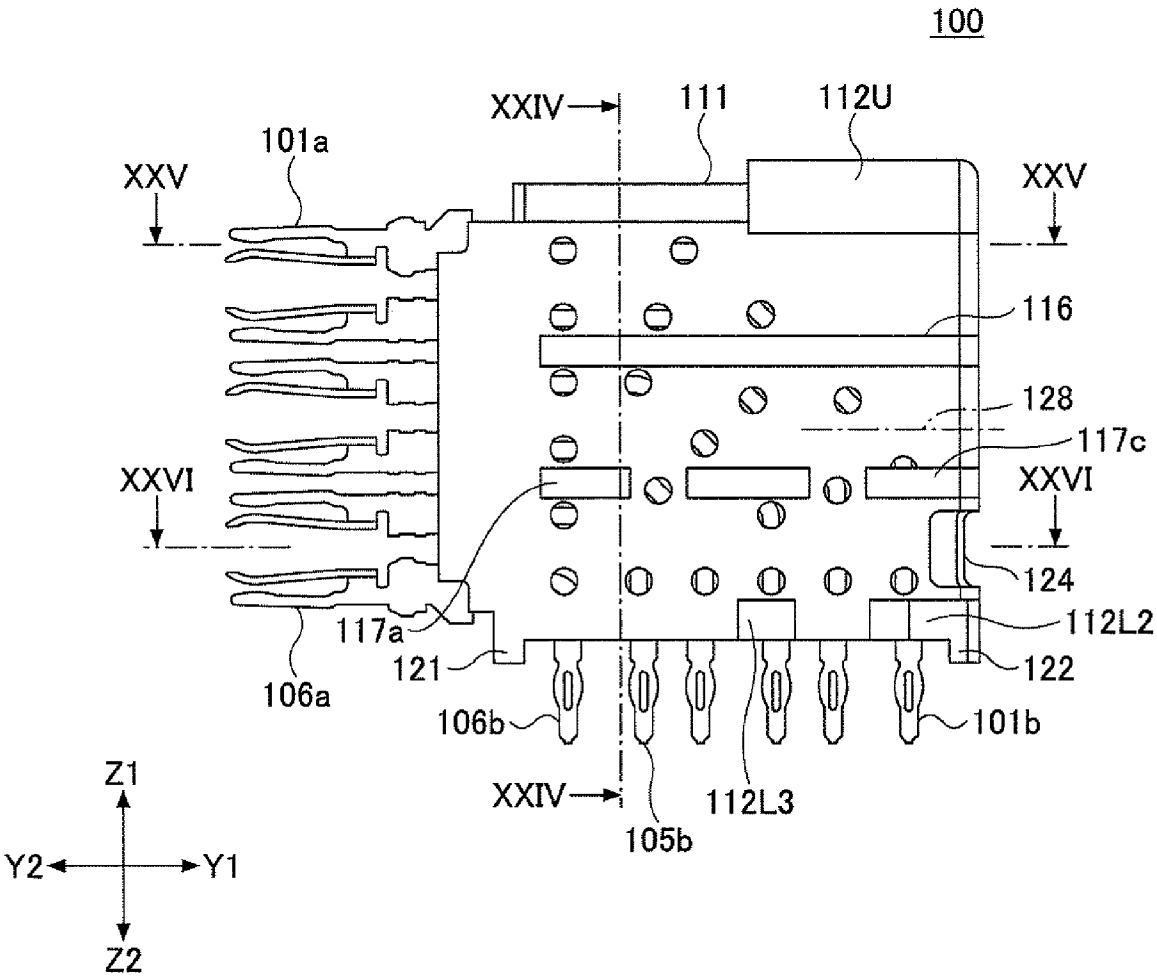
FIG. 24A is a front view of the contact module.
Figure 24B:
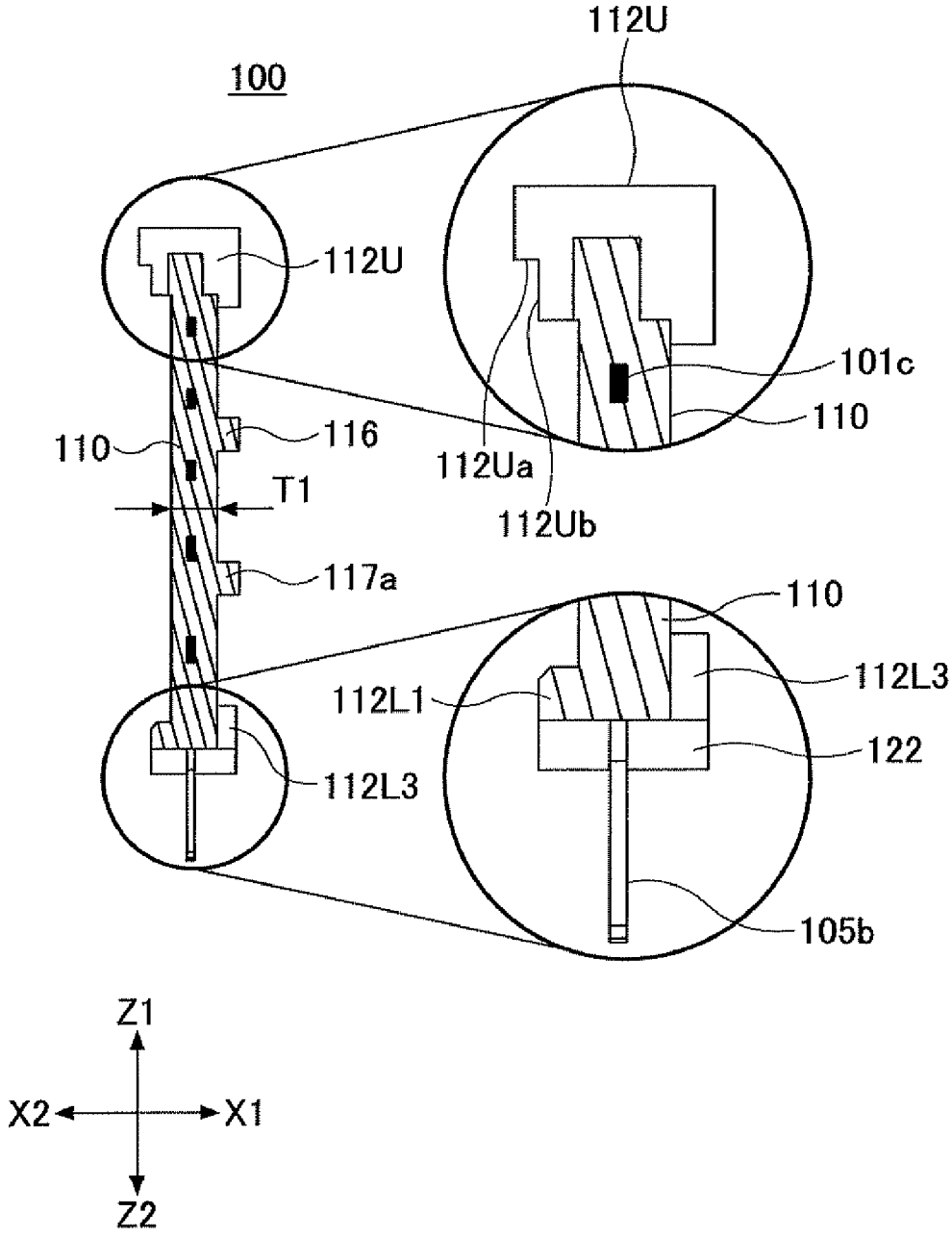
FIG. 24B is a cross-sectional view of the contact module and a shield member taken along a line XXIV-XXIV of FIG. 24A.
Figure 25:
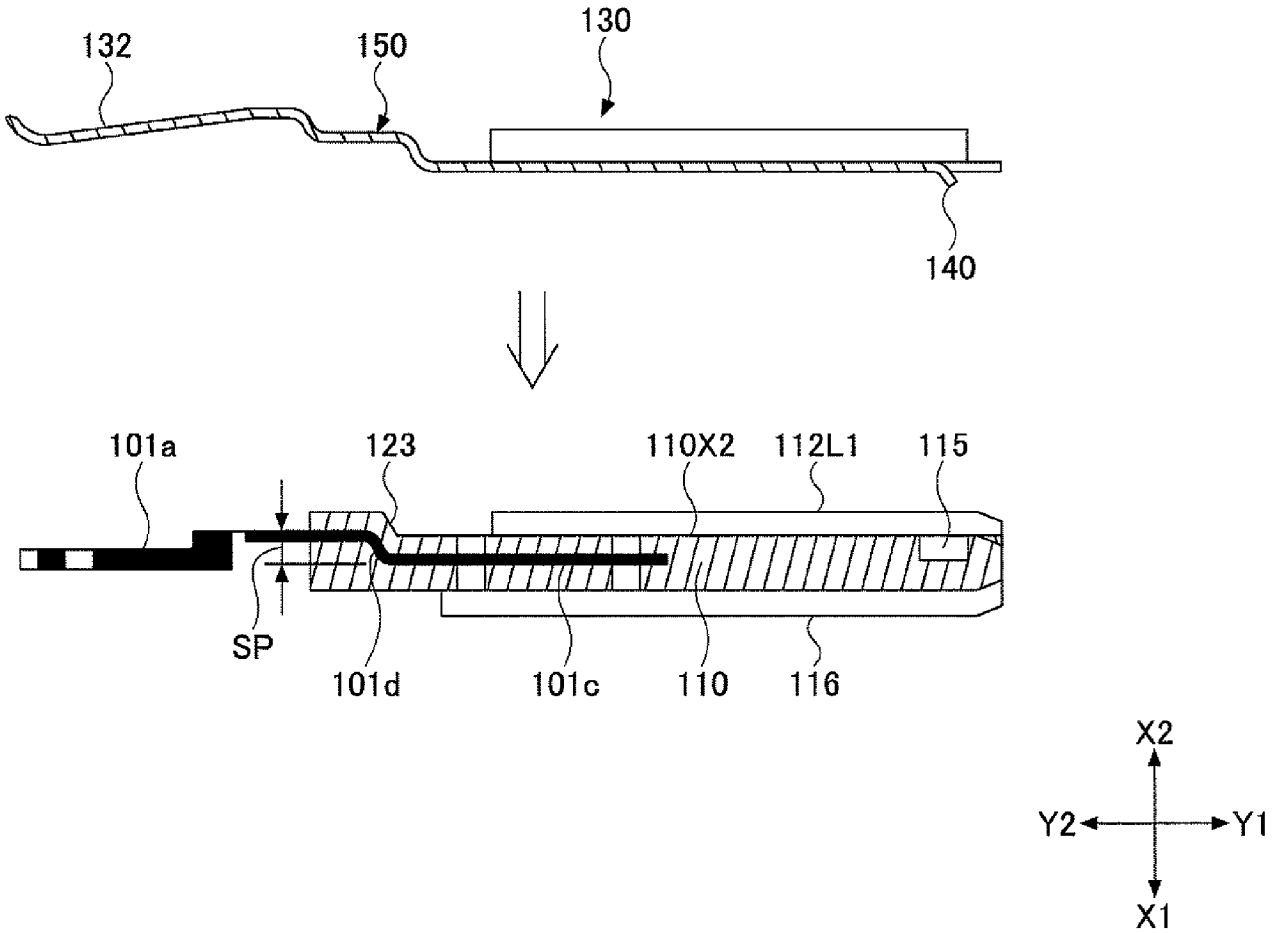
FIG. 25 is an enlarged cross-sectional view of the contact module taken along a line XXV-XXV of FIG. 24A.
Figure 26:
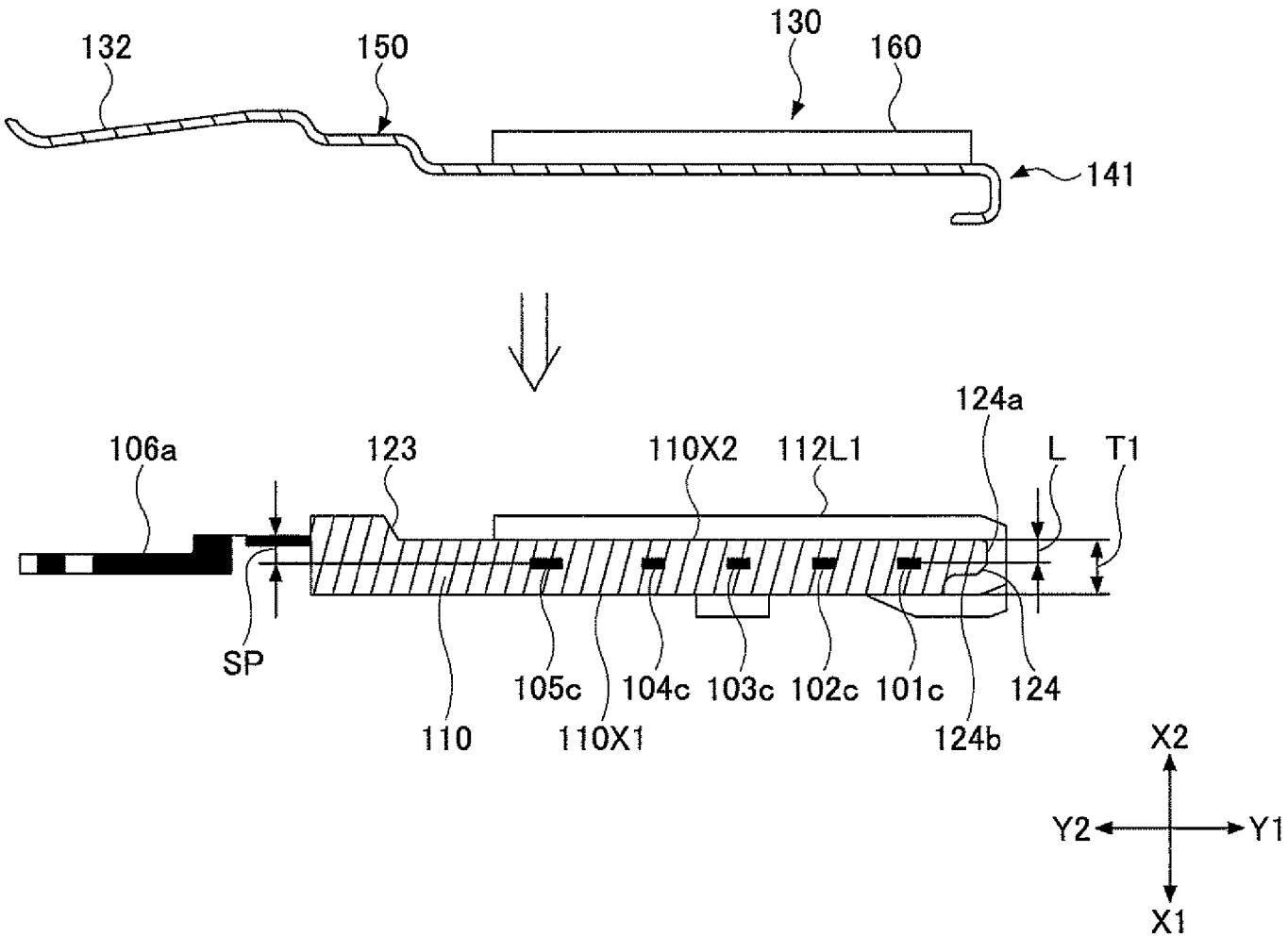
FIG. 26 is an enlarged cross-sectional view of the shield member and the contact module taken along a line XXVI-XXVI of FIG. 24A.

FIG. 22 is a perspective view of the contact module 100. FIG. 23 is a perspective view of the contact module 100 viewed from a different direction. FIG. 24A is a front view of the contact module 100. FIG. 24B is a cross-sectional view of the contact module 100 and the shield member 130 taken along a line XXIV-XXIV of FIG. 24A. FIG. 25 is an enlarged cross-sectional view of the contact module 100 taken along a line XXV-XXV of FIG. 24A. FIG. 26 is an enlarged cross-sectional view of the shield member 130 and the contact module 100 taken along a line XXVI-XXVI of FIG. 24A.

The contact module 100 is an insert mold component having a plate shape, and includes a plurality of contact members 101 through 106 having an L-letter shape and a module body 110 holding middle portions of the contact members 101 through 106 in an aligned state. The module body 110 is made of a plastic material having an electrically insulating function, and is a generally square-shaped plate having a thickness of T1. It should be noted that holes 120 are formed by mold pins used for pressing the contact members 101 through 106 when insert-molding the module 100.

The contact members 101 through 106 have body parts 101*c* through 106*c*, connection contact parts 101*a* through 106*a* and mounting terminal parts 101*b* through 106*b*, respectively. Each of the body parts 101*c* through 106*c* has an elongated L-letter shape or generally circular arc shape. The contact parts 101*a* through 106*a* are formed at ends of the body parts 101*c* through 106*c*, respectively. Each of the contact parts 101*a* through 106*a* has a forked shape. The mounting terminal parts 101*b* through 106*b* are formed on the opposite ends of the body parts 101*c* through 106*c*. Each of the mounting terminal parts 101*b* through 106*b* has a press-fit terminal structure.

As illustrated in FIG. 22 and FIG. 25, the body part 101*c* has a crank bent part 101*d* at a position close to the contact part 101*a*. As illustrated in FIG. 26, the mounting terminal part 102*b* exists in an extending direction of the body part 102, which direction is perpendicular to the drawing sheet. Using the mounting terminal part 101*b* as a reference, the contact part 101*c* has a step SP, which lifts the contact part 101*a* from the mounting terminal part 101*b* in the X2 direction. In other words, using the contact part 101*a* as a reference, the contact part 101*c* has the step SP, which lifts the mounting terminal part 101*b* from the contact part 101*a* in the X2 direction. Each of the body parts 102*c* through 106*c* has a crank bent part the same as the crank bent part of the body part 101*c*.

The contact part 101*a* has a forked shape, and has first and second contact pieces 101*a*-1 and 101*a*-2 facing each other. The first contact piece 101*a*-1 lies in a Y-Z plane. The second contact piece 101*a*-2 is bent in a horizontal direction and lies in an X-Y plane. The roll surface of the second contact piece faces the first contact piece 101*a*-1. A gap formed between the first and second contact pieces 101*a*-1 and 101*a*-2 is enlarged mainly by the second contact piece 101*a*-2 being elastically bent in the Z direction, which is a direction of thickness of the second contact piece 101*a*-2. Additionally, the first contact piece 101*a*-1 has a crank-shaped bent part 101*a*-1*a*, and an end of the first contact piece 101*a*-1 is in coincident with the second contact piece 101*a*-2, which is bent in a horizontal direction. The contact parts 102*a* through 106*a* have the same structure as the above-mentioned structure of the contact piece 101*a*.

The contact parts 101*a* through 106*a* protrude in the Y2 direction from the body part 110 and are aligned in the Z direction. The press fit terminal parts 101*b* through 106*b* protrude in the Z2 direction from the body parts 110, and are aligned in the Y direction. As illustrated in FIG. 25 and FIG. 26, the contact parts 101*a* through 106*a* and the mounting terminal parts 101*b* through 106*b* are located in the same Y-Z plane. The contact members 102 and 103 and the contact members 104 and 105 make pairs for balanced transmission.

The contact parts 101*a* on the Z1 side and the contact part 106*a* on the Z2 side are positioned so that each of the contact pieces, which is bendable in the direction of thickness, faces the center of the contact module 100 in the Z direction. The pair of contact parts 102*a* and 103*a* and the pair of the contact parts 104*a* and 105*a* are positioned on the side where each of the contact pieces, which is bendable in the direction of thickness, faces outside the contact module 100.

The outermost contact member 101 has bulge parts 101*e*, 101*f* and 101*g* in a portion of the body part 101*c* close to the contact part 101*a*. The bulge part 101*e* protrudes in the Z1 direction. The bulge parts 101*f* and 101*g* protrude in the Z1 and Z2 directions, respectively, in the same portion of the contact member 101 closer to the contact part 101*a* than the bulge part 101*e*.

The innermost contact member 106 has bulge parts 106*e*, 106*f* and 106*g* in a portion of the body part 106*c* close to the contact part 106*a*. The bulge part 106*e* protrudes in the Z2 direction. The bulge parts 106*f* and 106*g* protrude in the Z2 and Z1 directions, respectively, in the same portion of the contact member 106 closer to the contact part 106*a* than the bulge part 106*e*.

As illustrated in FIG. 26 and FIG. 25, the body parts 101*c* through 106*c* of the contact members 101 through 106 are located in the middle of the thickness T1 of the module body 110. The thickness T1 of the module body 110 is intentionally made small so that a distance L between the body parts 101*c* through 106*c* of the contact members 101 through 106 and a surface 110X2 of the module body 110 on the X2 side, which the shield member 130 is brought into contact with, is shorter than a distance LA (refer to FIG. 34B) of a case where the entire module body has the same thickness as is in the second embodiment mentioned later.

The module body 110 includes a guide rail part 111 and a flange part 112U on an end surface on the Z1 side. The module body 110 also includes a flange part 112L1, 112L2 and 112L3 and two stud parts 121 and 122 for mount-positioning on an end on the Z2 side. Further, the module body 110 includes a step part 123 on the Y2 side.

The guide rail part 111 is formed along a half portion of the end surface of the Z1 side on the Y2 side. The flange part 112U is formed along about the other half portion of the end surface of the Z1 side on the Y1 side.

The flange part 112L1 is formed along the entire length of the module body 110 in the Y1-Y2 direction on the surface 110X2 of the module body 110 on the X2 side. The flange parts 112L2 and 112L3 are formed on the surface 110X1 of the module body 110 on the X1 side in a portion at the end portion and the middle portion in the Y1 direction.

The module body 110 includes a plurality of ribs 116 and 117*a* through 117*c* at positions which equally divide the length of the surface 110X2 in the Z direction. Grooves 125, 126 and 127, which correspond to the above-mentioned shield piece rooms 27, 28 and 29, respectively, are formed on the surface of the module body 110 on the X2 side.

As illustrated in FIG. 24B, the side surface of the flange part on the X1 side, the surfaces of the flange parts 112L2 and 112L3 on the X1 side, and the ribs 116 and 117*a* through 117*c* lie in the same Y-Z plane. Similarly, as illustrated in FIG. 24B, a notch part 112Ua is formed on the X2 side of the flange part 112U. The bottom surface 112U*b* of the notch part 112U*a* and the surface of the flange part 112U*a* on the X2 side lie in the same Y-Z plane. Thereby, end openings of the guide grooves 50U and 50L are exposed in a state where the contact module is inserted into and attached to the housing 21.

Moreover, a notch 124 is formed in a portion of a rear end of the module body 110 in the Y1 direction, which portion is shifted from the center line 128 of the module body 110 in the Z direction by a distance L20. Specifically, the notch 124 is formed at a position between the rib 117*c* and the flange parts 112L1 and 112L2, that is, a portion close to the end of the module body 110 on the Z2 side. The notch part 124 includes a concave part 124*a*, which is formed on the rear end of the module body 110, and a concave part 124*b*, which is formed in the surface 110X1 of the module body 124*b* and connected to the concave part 124*a*. The distance L20 is about ½ of a distance L21 between the center line 128 of the module body 110 and the end of the module body 110 on the Z2 side.

Moreover, a concave part 115 of a rectangular shape is formed in a portion close to the end of the surface 110X of the body part 110 close to the end in the Y1 and also close to the end in the Z1 direction. Because the portion is positioned outside the body part 101*c* of the contact member 101, the concave portion 115 is prevented from interfering with the body part 101*c*.

A description will be given, with reference to FIG. 27A through FIG. 29, of a configuration of the shield member 130.

Figure 27A:
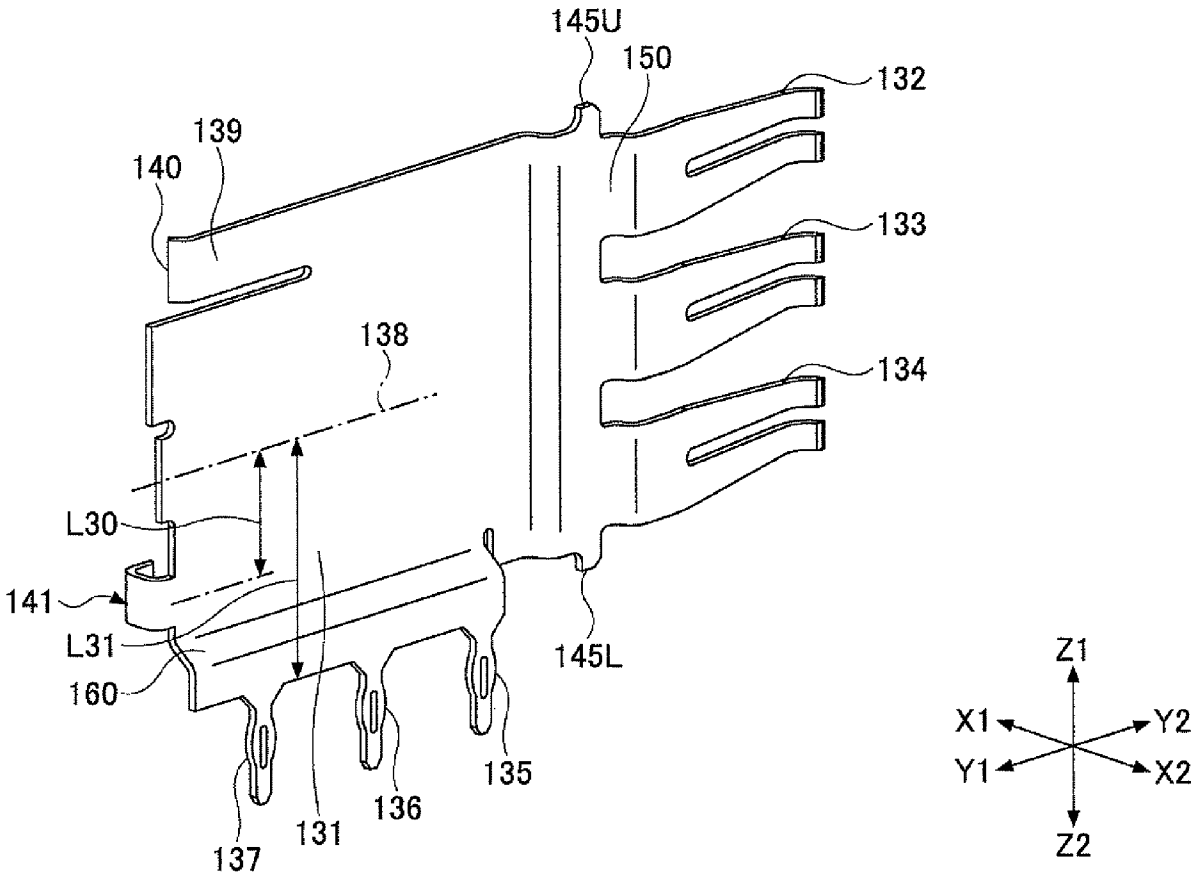
FIG. 27A is a perspective view of the shield member viewed from one direction.
Figure 27B:
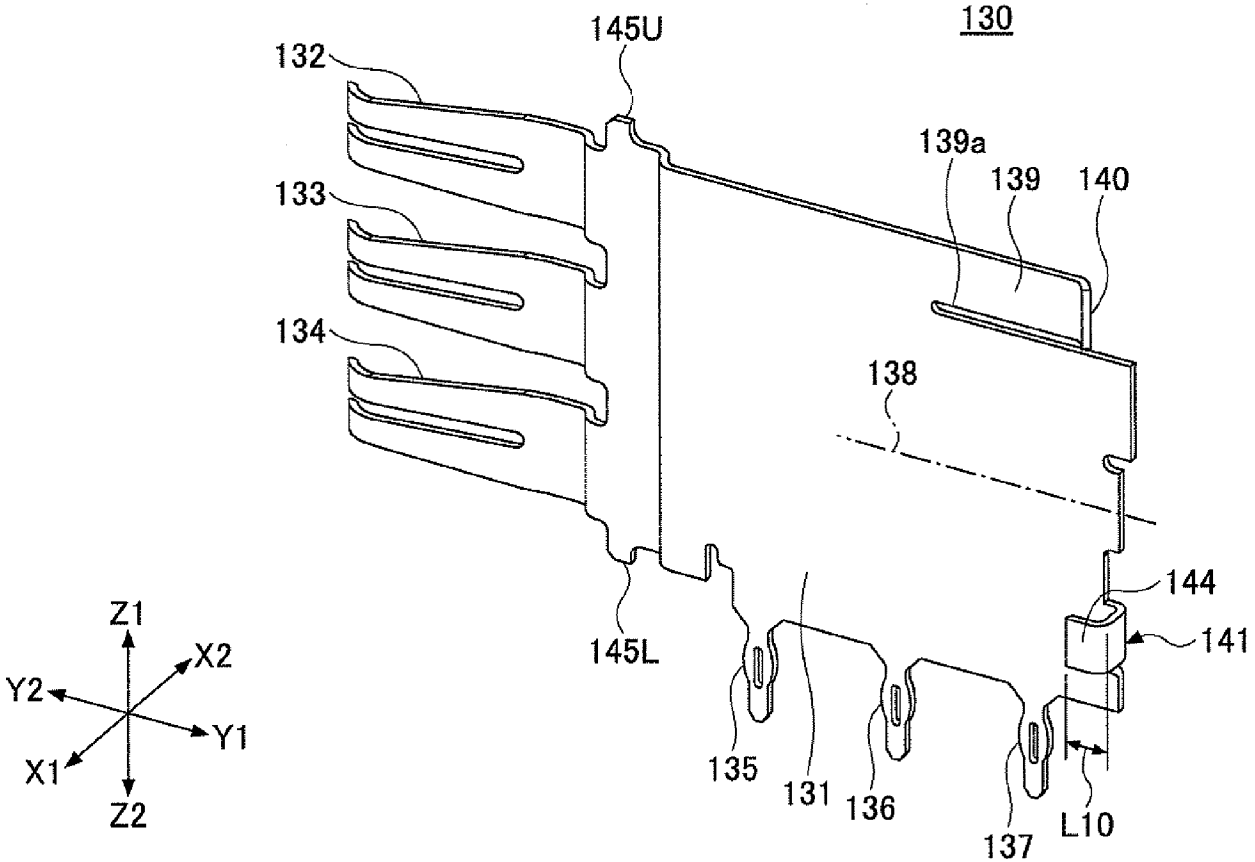
FIG. 27B is a perspective view of the shield member viewed from a different direction.
Figure 28:
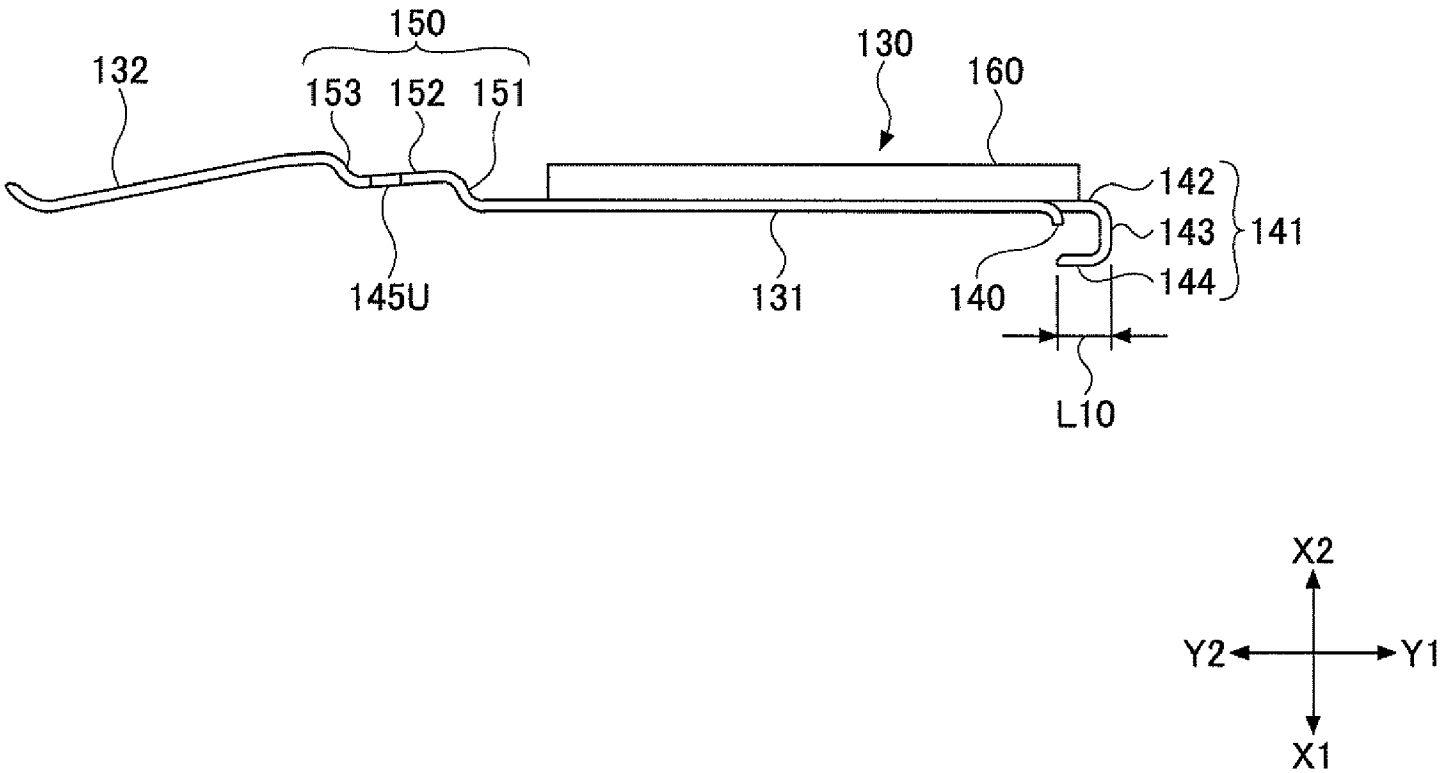
FIG. 28 is a plan view of the shield member.
Figure 29:
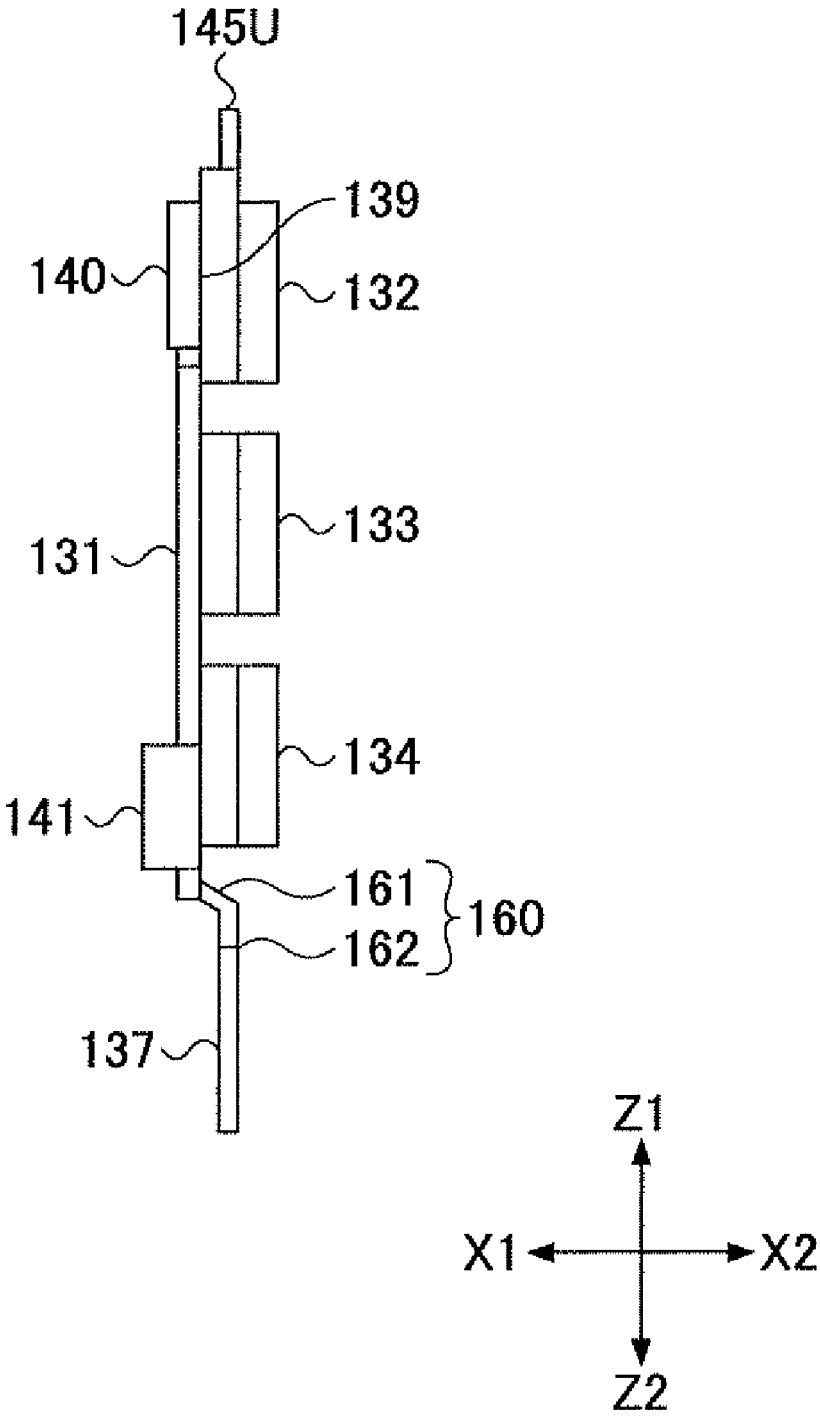
FIG. 29 is a side view of the shield member.

FIGS. 27A and 27B are perspective views illustrating the shield member 130 viewed from different directions. FIG. 28 is a plan view illustrating the shield member 130 of FIG. 27B viewed from the Z1 side. FIG. 29 is a side view illustrating the shield member 130 of FIG. 27B viewed from the Y1 side.

The shield member 130, which is a board-like member such as a metal plate, includes a rectangular-shaped shield body part 131, fork-shaped shield piece parts 132, 133 and 134 protruding in the Y2 direction from the shield body part 131 and aligning in the Z direction, and mounting terminal parts 135, 136 and 137 protruding in the Z2 direction from the shield member 131 and aligning in the Y direction. A single-dashed chain line 138 in FIGS. 27A and 27B indicates the center of the shield body part 131 in the direction of height (Z direction).

The shield body part 131 includes a lock piece 139 extending in the Y1 direction in a portion on the Z1 side. The lock piece 139 is formed by providing a slit 139*a* in the shield body part 131. The lock piece 139 has an L-shaped hook part 140 at an extreme end thereof.

Additionally, the shield body part 131 includes a U-shaped hook part 141 in a portion shifted from the center line 138 by a distance L30 in the Z2 direction in the vicinity of the mounting terminal part 137. The distance L30 is about ½ of the distance L31 between the center line 138 and an end of the shield body part 131 on the Z2 side. That is, the hook part 141 is located in a middle position between the center line 138 and an end of the shield body part 131 on the Z2 side. The hook part 141 includes a part 142 extending in the Y1 direction from the edge on the Y1 side, a part 143 extending in the X1 direction from the part 142, and a part 144 extending in the Y2 direction from the part 143.

The hook part 141 is configured to engage with an end of the shield body 110 in the Y1 direction from the Y1 side. There is no limitation in the length L10 of the part 144 of the hook part 141. The length L10 of the part 144 may be several millimeters so that the hook part 141 can be brought into engagement with the end of the module body in the Y1 direction.

Moreover, bulge parts 145U and 145L are formed on the end of the Y2-side end of the shield body part 131 to protrude in the Z1 and Z2 directions, respectively.

As illustrated in FIG. 28, the shield body part 131 has a step part 150, which is bent in two steps in the X2 direction, in a portion on the Y2-side end thereof. The step part 150 includes a first step part 151, which protrudes in the X2 direction from the shield body part 131, an intermediate step part 152 connecting to the first step part 15, and a second step part 153, which protrudes in the X2 direction from the intermediate step part 152.

The shield piece parts 132, 133 and 134 extend in the Y2 direction from the step part 153. The bulge parts 145U and 145L are formed on the upper and lower ends of the intermediate part 152, respectively. When viewing with the intermediate part 152 as a reference, the shield body part 131 is displaced in the X1 direction from the Y-Z plane containing the intermediate part 152.

As illustrated in FIG. 29, the shield body part 131 includes a step part 160 in the vicinity of the Z2-side end thereof. The step part 160 includes a step part 161 protruding in the X2 direction from the shield body part 131 and a step part 162 connecting to the step part 161. The mounting terminal parts 135, 136 and 137 protrude from the Z2-side end of the step part 162.

The step part 150 has a size and shape corresponding to the step part 123 of the module body 110. The step part 160 has a size and shape corresponding to the flange part 112L1 of the module body 110.

A description will be given below of a configuration and structure of the jack connector 20.

As illustrated in FIG. 4A through 14, the jack connector 20 is completed by inserting a plurality of shield members 130 into gaps between adjacent contact modules 100 from a rear side of the housing 21 after forming the gaps by inserting a plurality of contact modules 100 into the housing 21 from the rear side thereof so that the contact modules 100 are aligned in the longitudinal direction of the housing 21 with the gap between the adjacent contact modules 100. Thus, the contact modules and the shield members 130 are alternately arranged in the housing 21 in the longitudinal direction of the housing 21.

In the figures, the contact modules 100 are fixed to the housing 21 at positions indicated by P1 through P6. The shield members 130 are fixed to the housing 21 at positions indicated by Q1 and Q2. The shield members 130 and the contact modules 100 are coupled at positions indicated by R and S. Especially as illustrated in FIG. 9, each of the contact modules 100 is attached to the housing 21 by the guide rail part 111 being guided by the guide groove 43 and being inserted into the housing 21 until the Y2-side end surface of the flange part 112U contacts the end surface 41U of the protruding part 40U.

The contact part 101*a* is accommodated in the contact part room 23, the contact parts 102*a* and 103*a* are accommodated in the room 24, the contact parts 104*a* and 105*a* are accommodated in the room 25, and the contact part 106*a* is accommodated in the room 26. The guide rail part 111 fits to the guide groove part 43, and the bulge part 101*e* fits to the guide groove part 430 and is pressed into the ceiling part of the guide groove part 430 (P1). The bulge part 106*e* fits to the guide groove part 43L and is pressed into the bottom surface part of the guide groove part 43L (P2).

The bulge parts 101*f* and 101*g* are pressed into the ceiling part and the bottom surface part of the room 23, respectively (P3, P4). The bulge parts 106*f* and 106*g* are pressed into the bottom surface part and the ceiling part of the room 26, respectively (P5 and P6).

As illustrated in FIG. 7, in the adjacent contact modules 100 in the housing 21, the flange parts 1120 are arranged with no gap therebetween, and the flange parts 112L1, 112L2 and 112L3 on the Z2 side are arranged with a small gap corresponding to the thickness of the shield member 130. In the middle portion between the Z1 side and the Z2 side, there is formed a relatively large gap 90. The gap 90 is partitioned into three passages 91, 92 and 93 in response to the groove parts 125, 126 and 127 of the contact module 100.

As illustrated in FIG. 10 especially, each of the shield members 130 is inserted into a final position and attached to the housing 21 by inserting into a final position while the bulge parts 145U and 145L are guided by the guide grooves 50U and 50L, respectively, the shield piece parts 132, 133 and 134 are guided by the above-mentioned passages 91, 92 and 93, and the step part 162 are inserted into the above-mentioned small space.

As illustrated in FIG. 10, the shield piece parts 132, 133 and 134 are accommodated in the shield piece part rooms 27, 28 and 29, respectively. The bulge part 145U is pressed into the ceiling part of a deep portion of the guide groove 50U (Q1). The bulge part 145L fits to the guide groove 50L and is pressed into the bottom surface part of the guide groove 50L (Q2).

The shield body part 131 of the shield member 130 is in contact with a surface of the module body on the X2 side. The hook part 140 of the lock piece 139 fits and engages the concave part 115 (R). The hook part 141 fits and engages the notch 124 on the end of the module body on the Y2 side to surround the Y2-side end of the module body 110 (S).

A description will be given below of an electric characteristic of the jack connector 20.

The contact parts 101*a* through 106*a* are accommodated in the contact part rooms 23 through 26, respectively, and the shield piece parts 132, 133 and 134 are accommodated in the shield piece part rooms 27 and 28, and 29, respectively. The shield piece parts 132, 133 and 134 shield the adjacent contact parts 101*a* through 106*a* in the X1-X2 direction, and the shield body part 131 shield the adjacent body parts 101*c* through 106*c* in the X1-X2 direction.

Additionally, as illustrated in FIG. 11, in each of the contact modules 100, the distance L between the shield body part 131 of the shield member 130 and the body parts 101*c* through 106*c* of the contact members 101 through 106 is shorter than the distance LA of a case where the entire module body has the same thickness, thereby improving an accuracy of impedance matching.

A description will be given below of a mechanical characteristic of the jack connector 20.

The shield member 130 serves as an anchor member to prevent the contact module 100 from being moved out of the housing 21 in the Y1 direction. That is, the contact modules 100 are fixed to the housing at positions P1 through P6. The shield members 130 are fixed to the housing 21 at positions Q1 and Q2. The contact modules 100 are fixed to the shield member 130 at positions R and S. Thereby, the contact modules 100 are prevented from being moved out of the housing in the Y1 direction by the shield members 130 in addition to the contact modules 100 themselves.

As illustrated in FIG. 1 and FIGS. 4A and 4B, due to the hook part 141 fitting to module body 110, the exposed shield body part 131 of the shield member 130 is mechanically coupled to the module body 110 at a portion close to the Z2 side rather than the center line 138 so that the shield body part 131 cannot be displaced in the X2 direction, that is, the shield body part 131 cannot be turned up.

The shield body part 131 of the shield member 130 is prevented from being turned up in order to prevent the mounting terminal parts 135, 136 and 137 from being displaced in the X2 direction. It is important to connect the portions of the shield body part 131 close to the mounting terminal parts 135, 136 and 137 to the module body 110 in the Z direction.

In the present embodiment, because the hook part 141 is located at a position shifted from the center line 138 to the Z2 side by a predetermined distance in the shield body part 131, the portions of the shield body part 131 on the Z2 side where the mounting terminal parts 135, 136 and 137 are arranged are effectively prevented from being turned up as compared to a case where a hook part is located at the center line 138 in the shield body part 131.

It should be noted that the hook part 141 is arranged to surround the rear end part of the module body 110, and the length of the part 144 is sufficiently long and the depth of fitting to the module body 110 is sufficient, thereby preventing the hook part 141 from being undesirably disengaged from the module body 110.

Additionally, because the hook part 141 is U-shaped and arranged to surround the notch 124 of the back surface of the module body 110, the hook part 141 naturally fits to the notch 124 in a process of inserting and attaching the shield member 130 from the Y2 side in a state where the contact modules 100 are aligned and fixed to the housing 21. Thereby, there is no need to provide a special process to fit the hook part 141 to the notch 124.

Additionally, because the shield member press parts 30 and 31 press portions on the Y2 side of the shield body part 131 of the shield member 130, the side of the shield body part 131 where the shield piece parts 132, 133 and 134 are provided is prevented from being lifted from the surface 110X2 of the module body 110.

In the shield member 130, which is not exposed, in addition to the hook part 141 fitting to the notch 124 of the rear end of the module body 110, the flange parts 112L2 and 112L3 of the contact module 100 located on the X2 side press the step part 162. Thereby, the portion of the end of the shield body part 131 on the Z2 side is prevented from being turned up.

Additionally, the hook part 141 is accommodated in the concave parts 124*a* and 124*b* so that the hook part 141 does not protrude from the rear end surface of the module body 110 and does not protrude from the surface 110X1.

The contact module 100 of the jack connector includes two studs 121 and 122. As illustrated in FIG. 3, the jack connector 20 is fixed to the daughter board 16 by being positioned to the daughter board 16 in a state where the two studs 121 and 122 of the contact module 100 are in contact with the daughter board 16.

In a case where one stud is provided to the contact module and the other stud is provided to the housing, an influence of assembling accuracy of the jack connector appears in the accuracy in the positions of the two studs. Such an influence causes a variation in the mounting accuracy of the daughter board when the jack connector is mounted to the daughter board.

However, in the present embodiment, because the two studs 121 and 122 are provided in the contact module 100, the assembling accuracy of the jack connector 20 does not have an influence on the positional accuracy of the two studs 121 and 122. Accordingly, there is only a small variation in the mounting accuracy when the jack connector is mounted to the daughter board 16.

Second Embodiment

Figure 30:
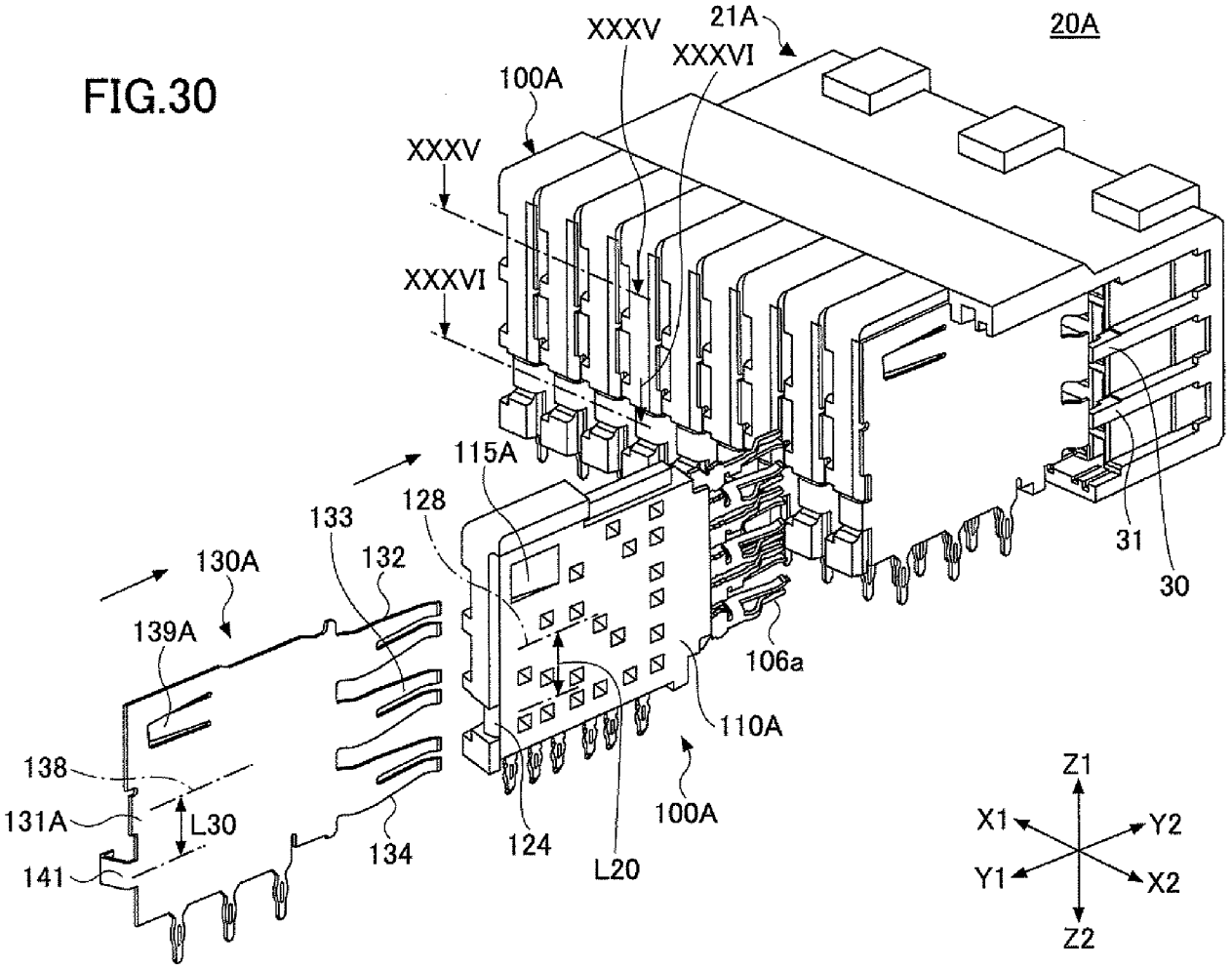
FIG. 30 is a perspective view of a jack connector according to a second embodiment of the present invention.
Figure 31A:
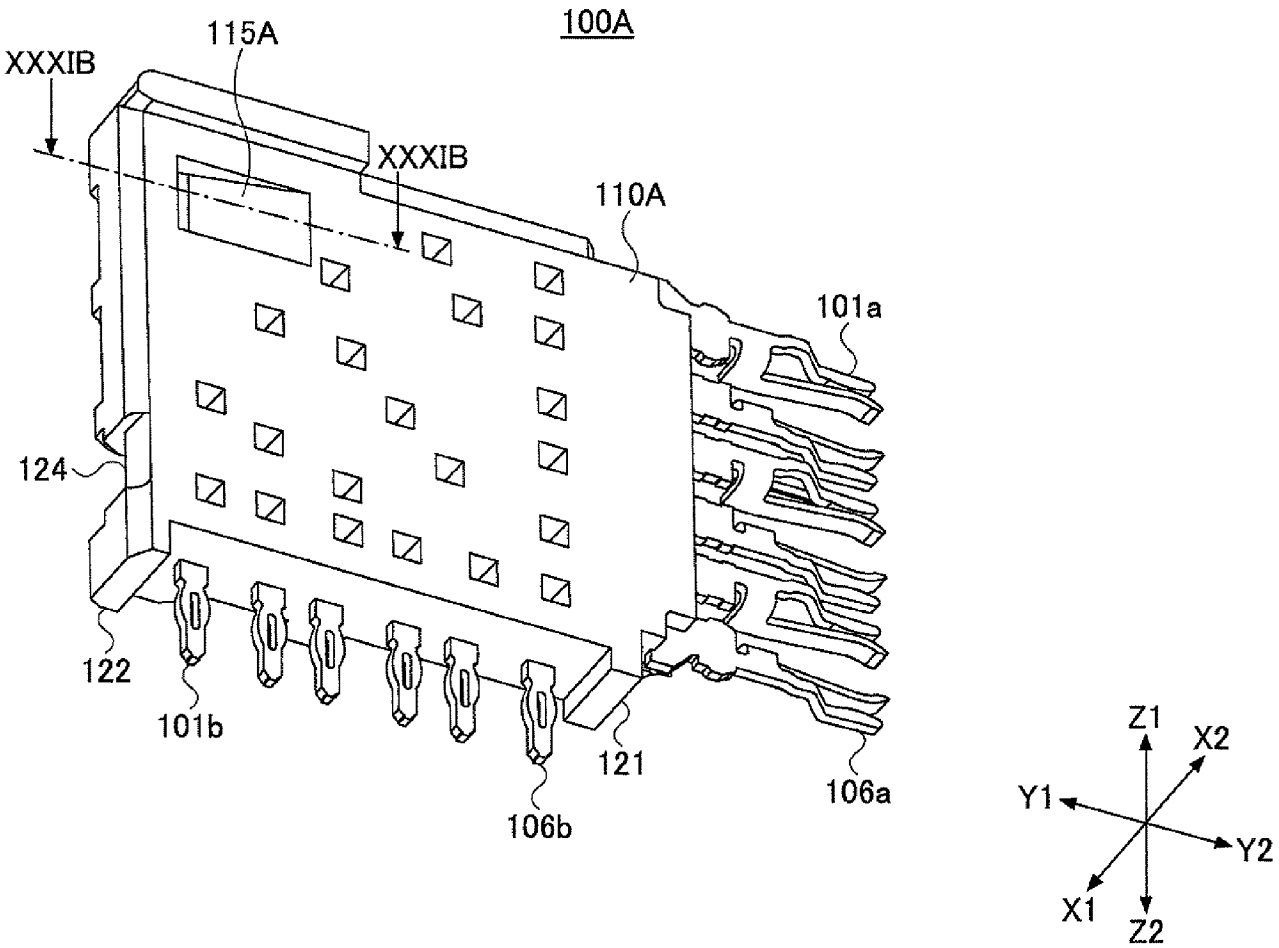
FIG. 31A is a perspective view of the contact module according to the second embodiment.
Figure 31B:
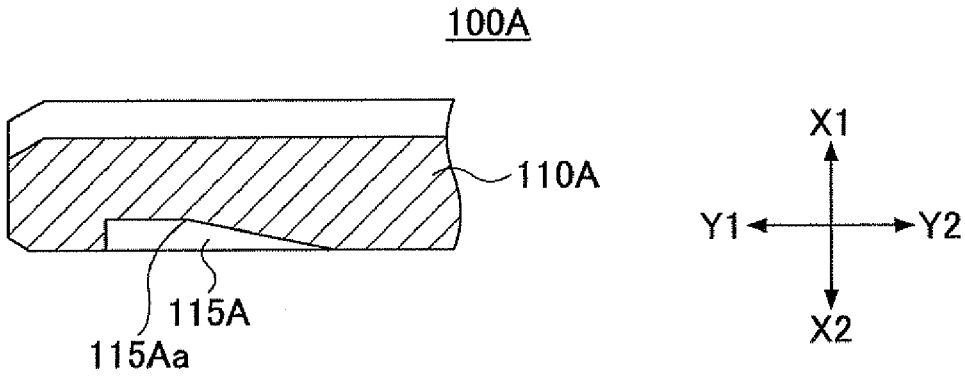
FIG. 31B is an enlarged cross-sectional view taken along a line XXXIB-XXXIB of FIG. 31A.
Figure 31C:
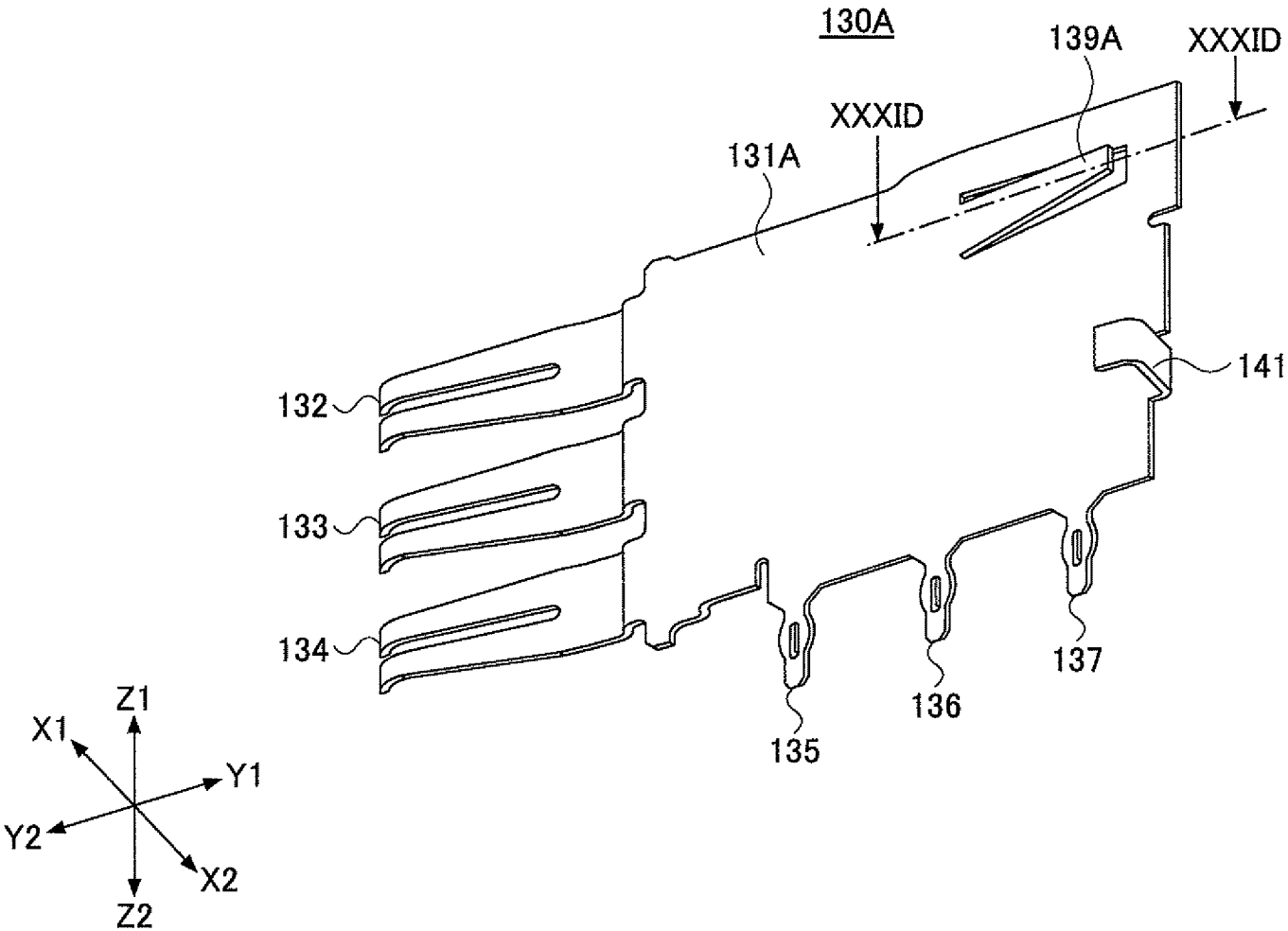
FIG. 31C is a perspective view of a shield member according to the second embodiment.
Figure 31D:
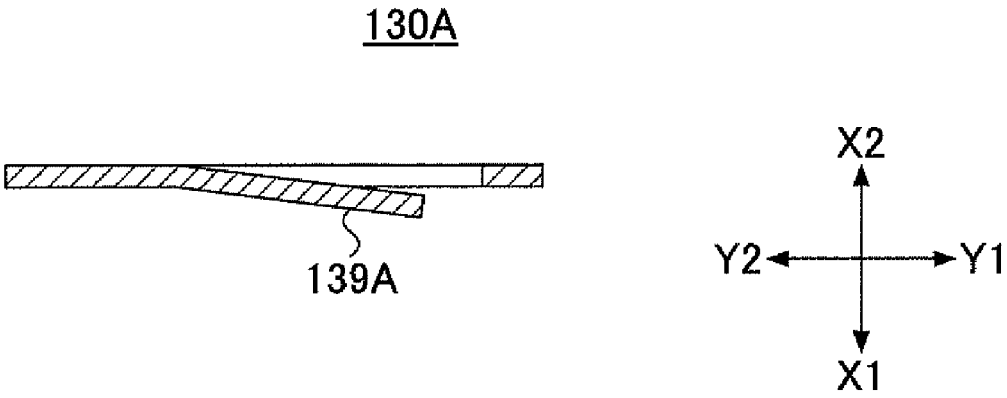
FIG. 31D is an enlarged cross-sectional view taken along a line XXXID-XXXID of FIG. 31C.
Figure 32:
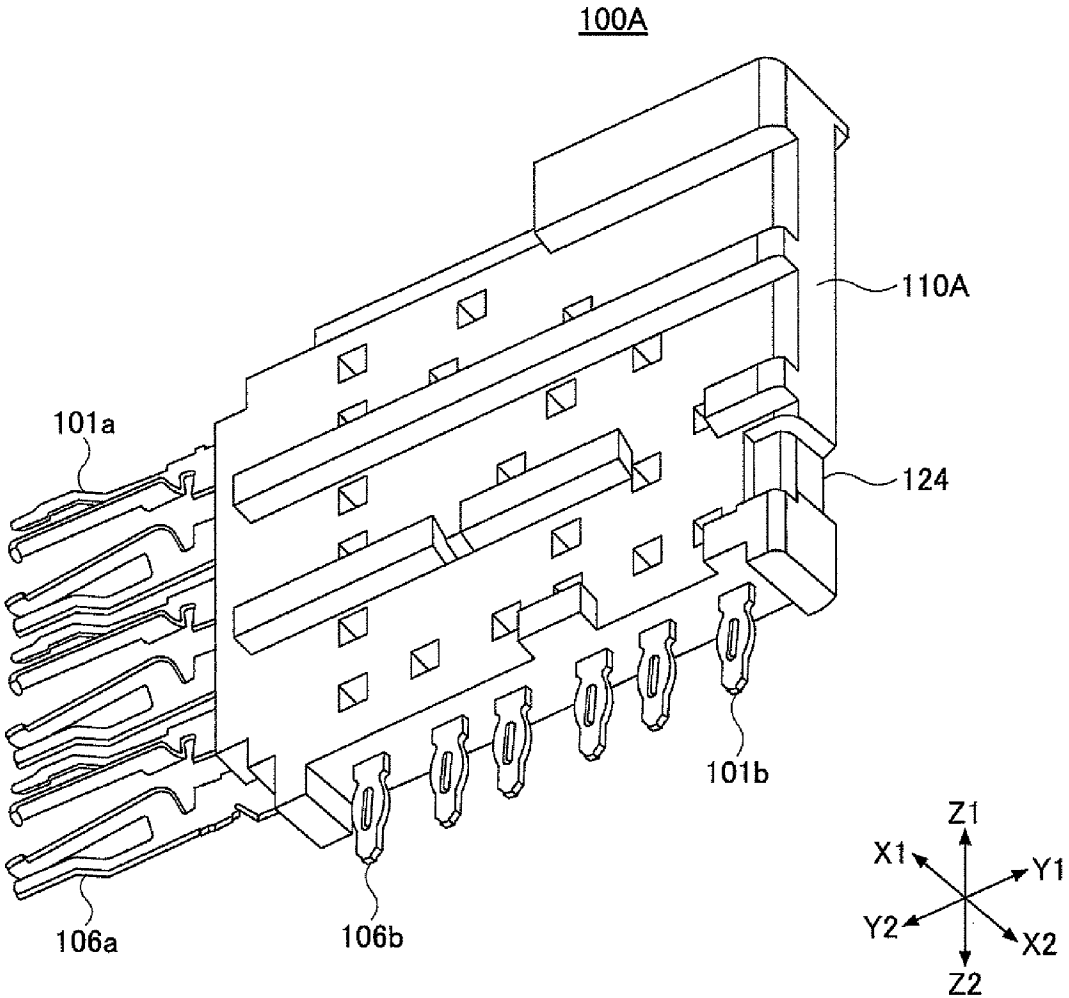
FIG. 32 is a perspective view of the contact module according to the second embodiment.
Figure 33A:
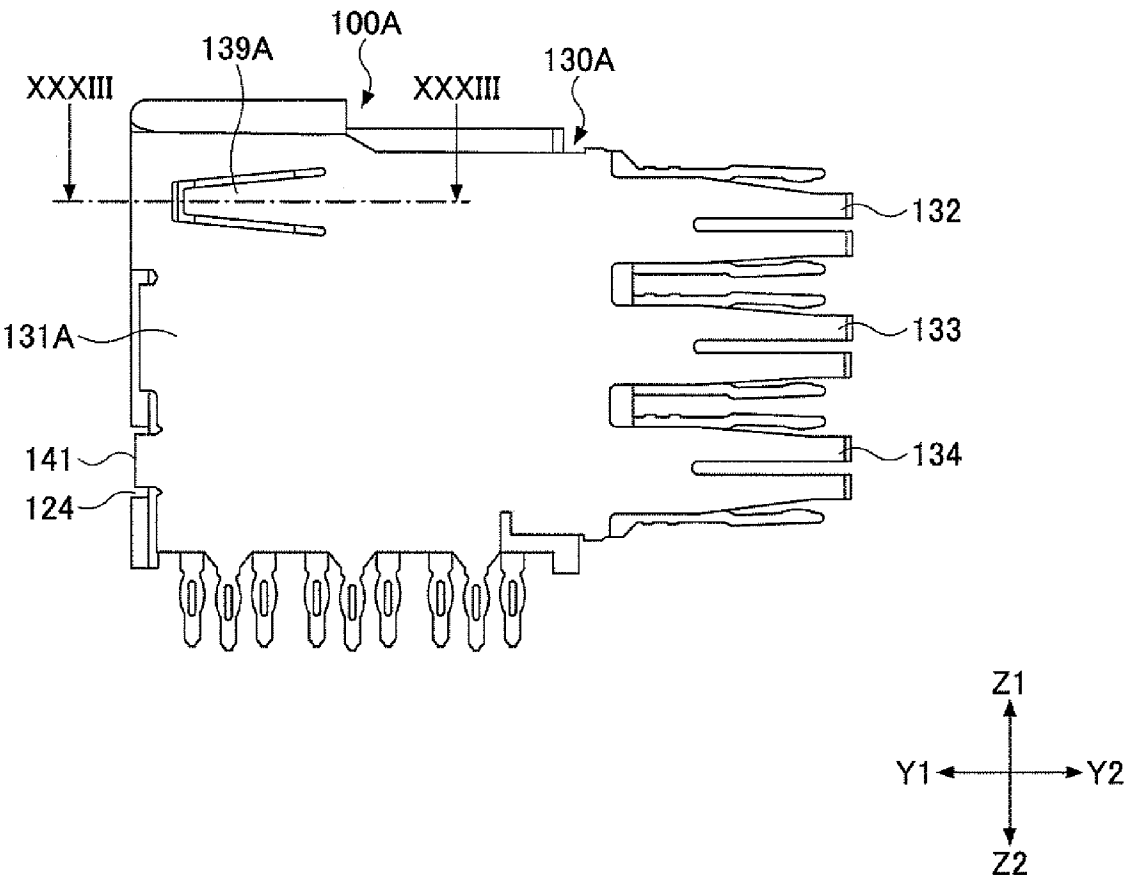
FIG. 33A is a front view of the contact module according to the second embodiment.
Figure 33B:
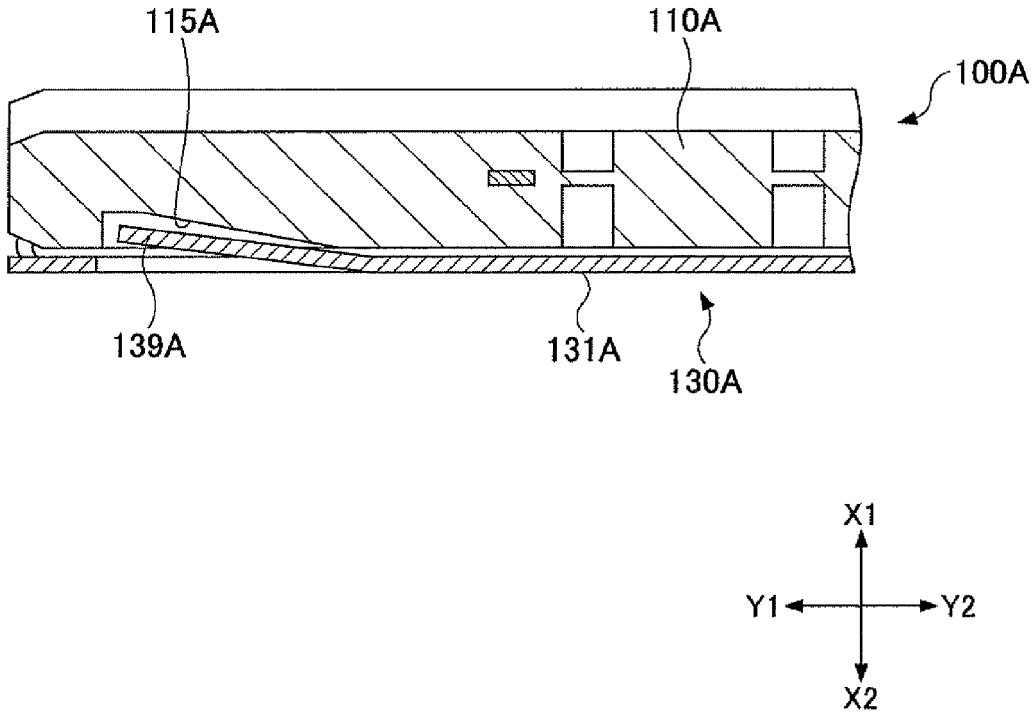
FIG. 33B is an enlarged cross-sectional view taken along a line XXXIII-XXXIII of FIG. 33A.

FIG. 30 is a perspective view of a jack connector 20A according to a second embodiment of the present invention. FIG. 31A is a perspective view of a contact module 100A. FIG. 31B is an enlarged cross-sectional view taken along a line XXXIB-XXXIB of FIG. 31A. FIG. 31C is a perspective view of a shield member 131A. FIG. 31D is an enlarged cross-sectional view taken along a line XXXID-XXXID of FIG. 31C. FIG. 32 is a perspective view of the contact module 100A. FIG. 33A is a front view of the contact module 100A. FIG. 33B is an enlarged cross-sectional view taken along a line XXXIII-XXXIII of FIG. 33A.

As illustrated in FIG. 30, in the jack connector 20A, a plurality of contact modules 100A and shield members 130A are inserted into the housing 21A from the rear side so that the contact modules 100A and the shield members 130A are alternately arranged in the longitudinal direction of the jack connector 20A. The housing 21A, the contact module 100A and the shield member 130A have substantially the same structures as the housing 21, the contact module 100 and the shield member 130, which constitute the jack connector 20 according to the above-mentioned first embodiment.

A description will be given below of a difference in structure between the jack connector 20A according to the second embodiment and the jack connector 20 according to the first embodiment.

Figure 34A:
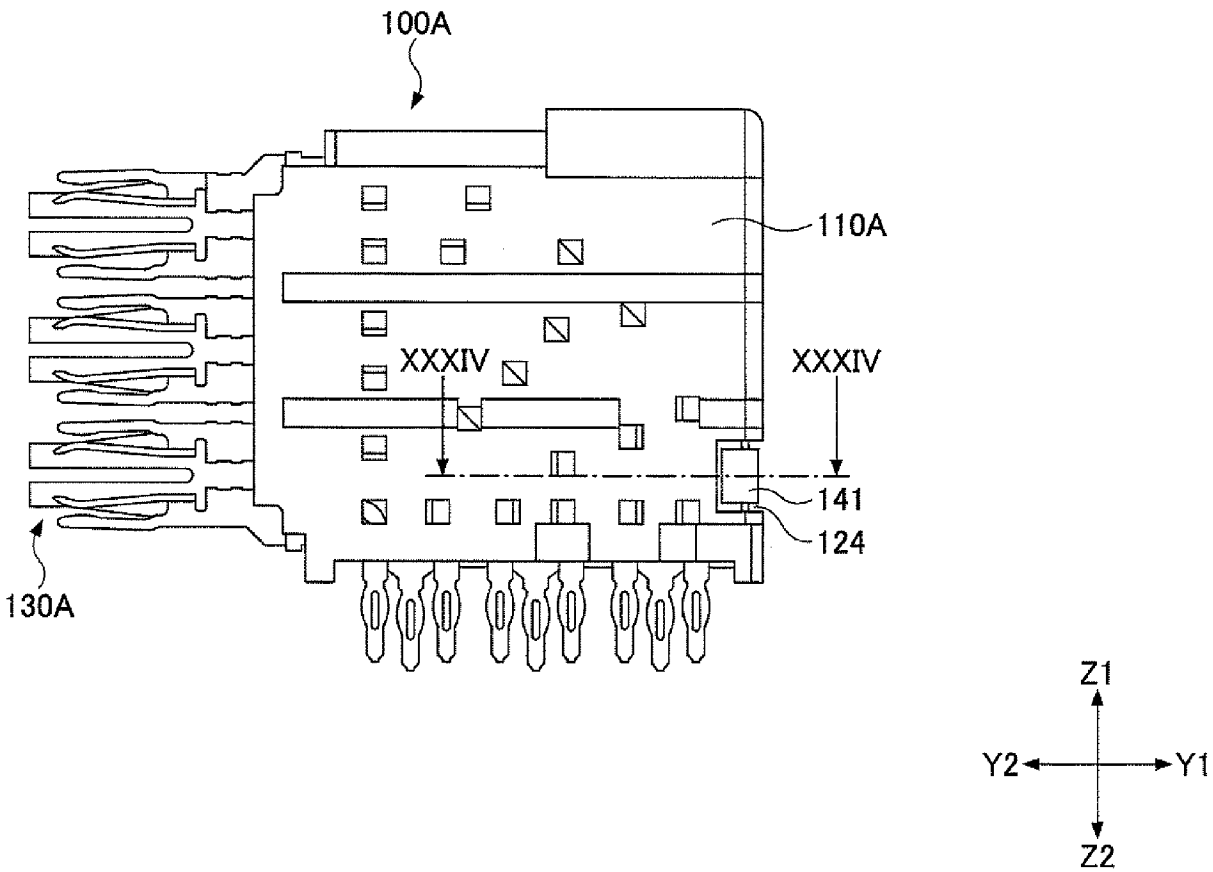
FIG. 34A is a front view of the contact module with the shield member attached thereto.
Figure 34B:
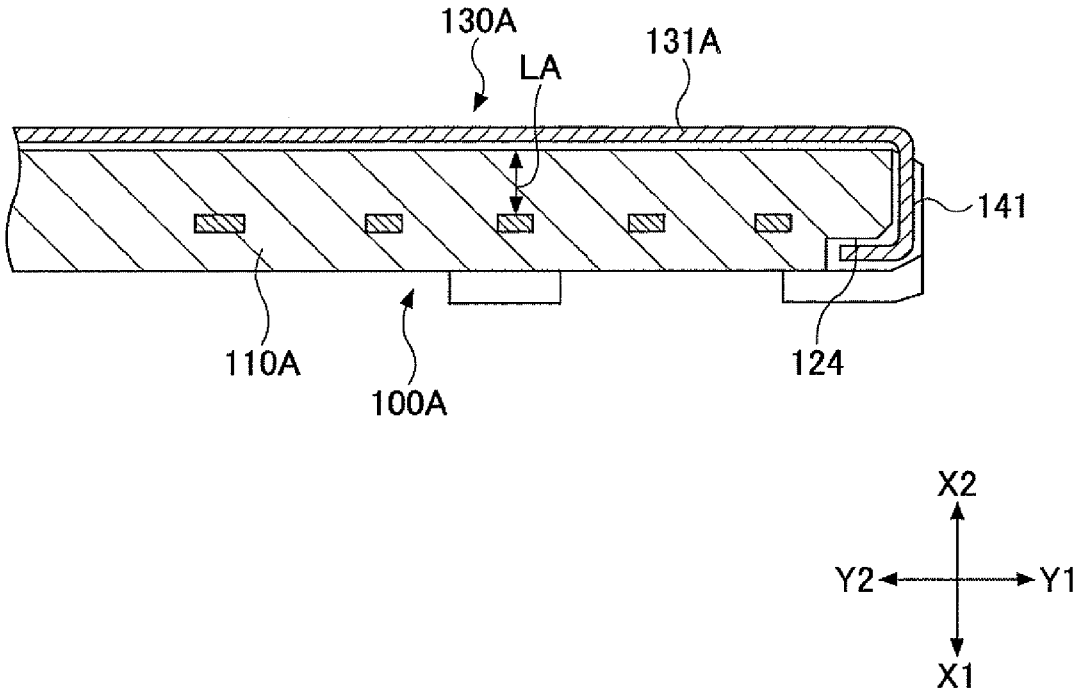
FIG. 34B is an enlarged cross-sectional view taken along a line XXXIV-XXXIV of FIG. 34A.

As illustrated in FIG. 31A through 32, the entire module body 110A of the contact module 100A has the same thickness as the thickness of the contact parts 101*a* through 106*a*. Similar to the module body 115, the module body 115A has a concave part 115A and a notch 124. As illustrated in FIG. 31B, the bottom surface 115Aa of the concave part 115A has an inclined surface so that the depth of the concave part 115A increases toward the Y1 side. The shield member 130A has a lock piece 139A and a hook part 141, and does not have the above-mentioned step parts 150 and 160. The lock piece 139A is formed by bending up a portion of the shield body part 131A so that the lock piece 139A is inclined relative to the shield body part 131A as illustrated in FIG. 31B. As illustrated in FIGS. 33A and 33B, the lock piece 139A fits to the concave part 115A. As illustrated in FIGS. 34A and 348, the hook part 141 is U-shaped, and arranged to surround the notch 124 located at the rear end of the module body 110A.

Figure 35:
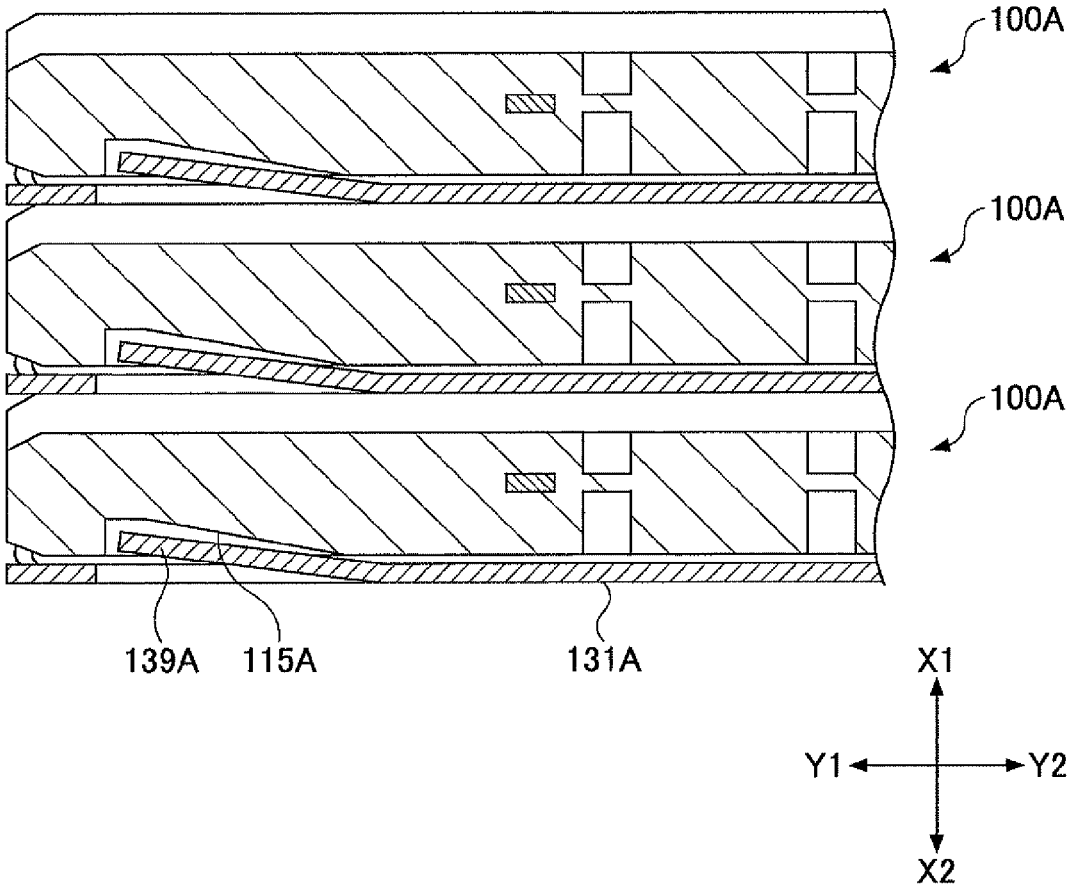
FIG. 35 is an enlarged cross-sectional view of portions of the contact modules and the shield members, which are alternately arranged, taken along a line XXXV-XXXV of FIG. 30.
Figure 36:
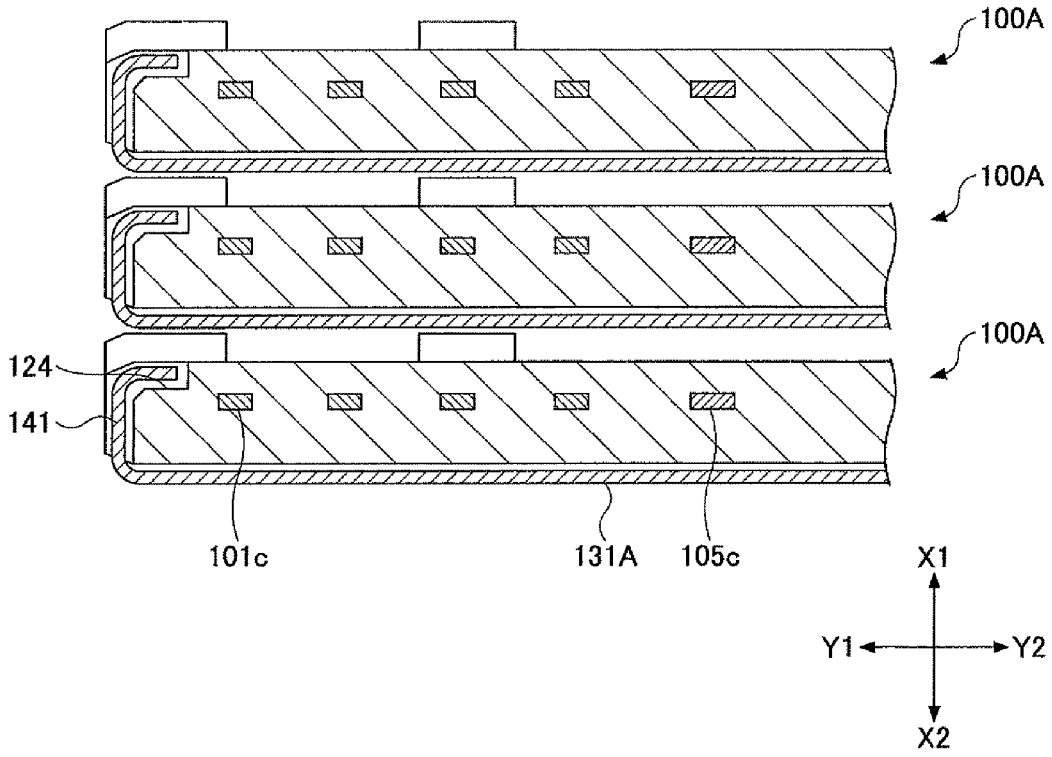
FIG. 36 is an enlarged cross-sectional view of portions of the contact modules and the shield members, which are alternately arranged, taken along a line XXXVI-XXXVI of FIG. 30.

The concave parts 115A of the contact modules 100A and the lock pieces 139A of the shield members 130A are alternately arranged as illustrated in FIG. 35. Similarly, the hook parts 141 of the shield members 130A and the notches 124 of the contact modules 100A are alternately arranged as illustrated in FIG. 36.

According to the above-mentioned structure, the shield body part 131A of the shield member 130A, which is exposed at the end of the jack connector 20A on the X2 side, is prevented from being turned up due to the hook part 141 engaging with the contact module 100A to surround the notch 124.

Third Embodiment

Figure 37:
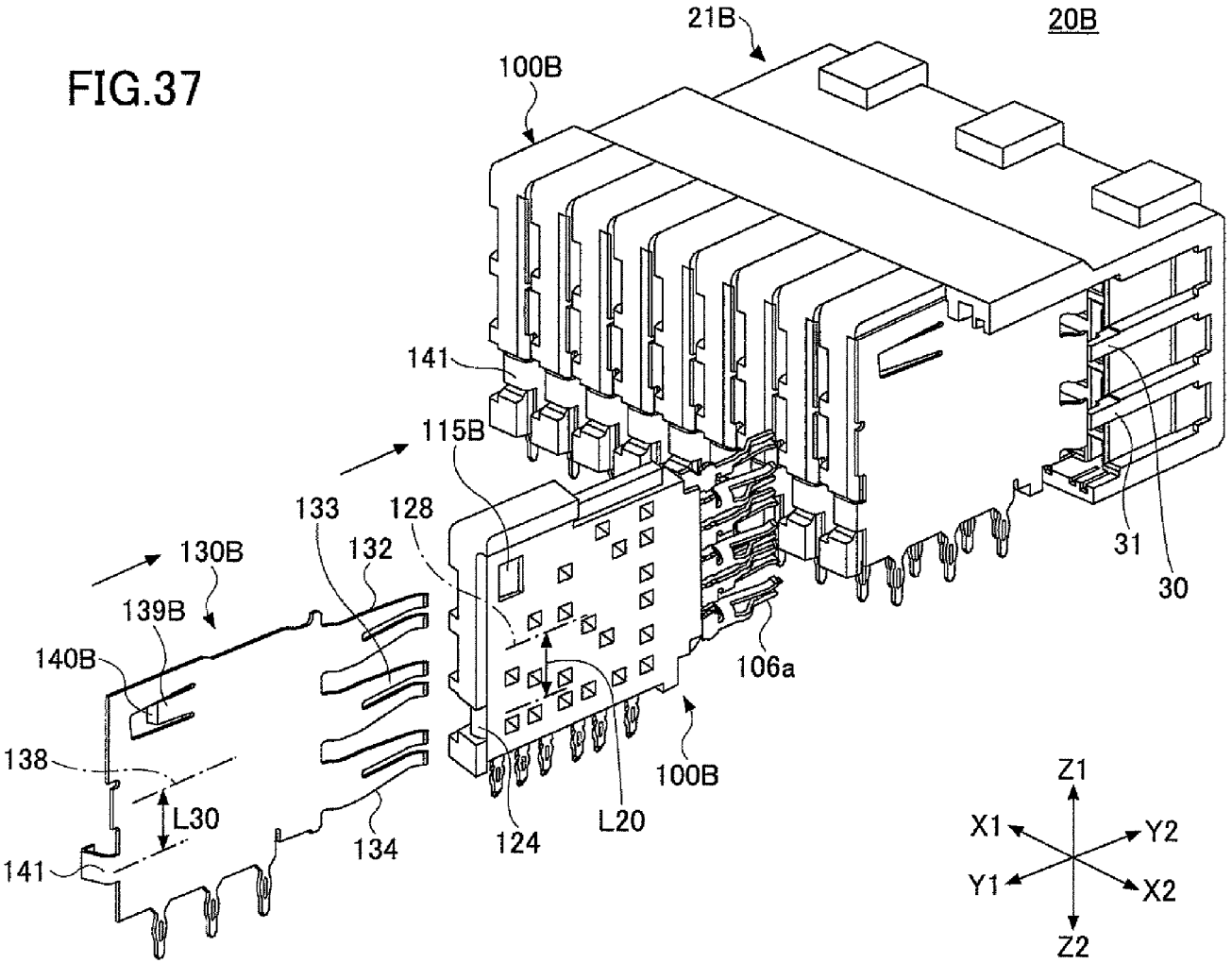
FIG. 37 is a perspective view of a jack connector according to a third embodiment of the present invention.
Figure 38A:
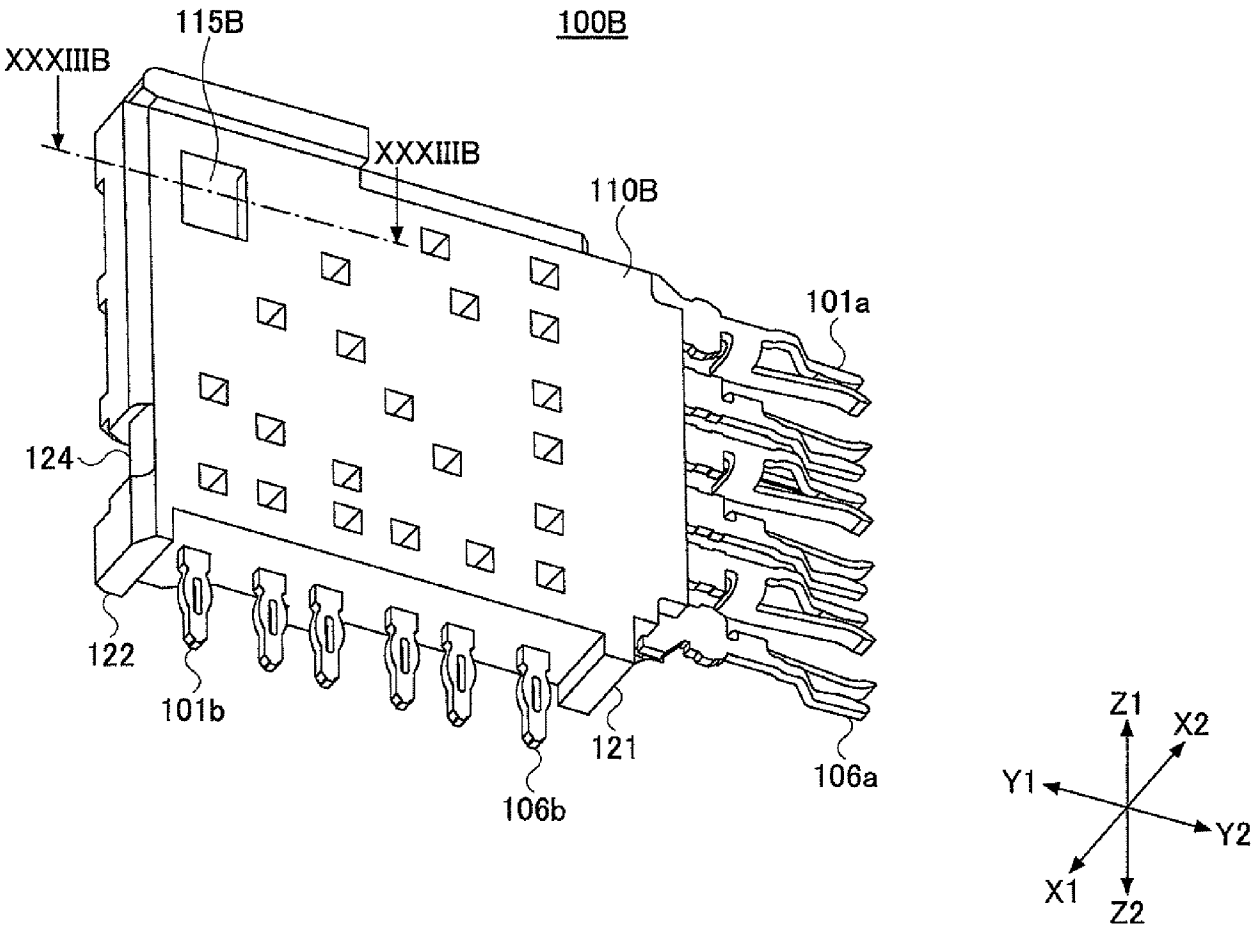
FIG. 38A is a perspective view of a contact module according to the third embodiment.
Figure 38B:
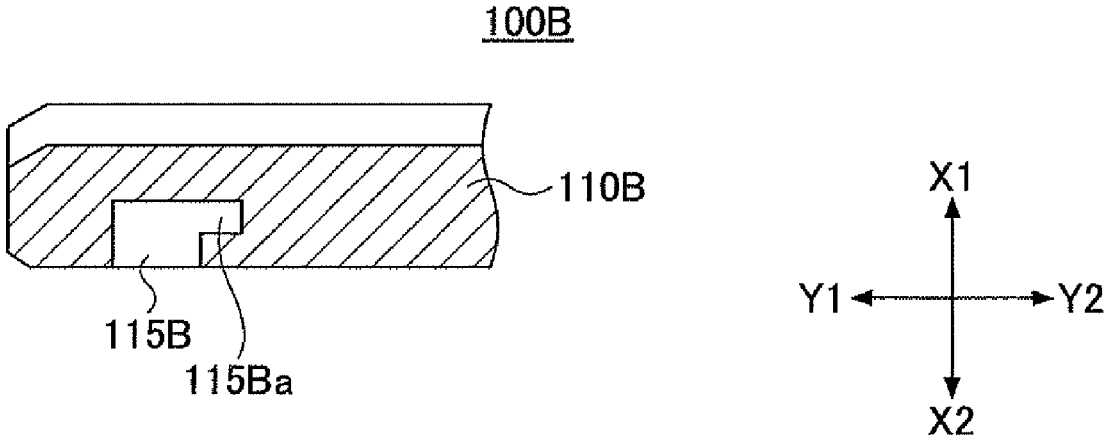
FIG. 38B is an enlarged cross-sectional view taken along a line XXXVIIIB-XXXVIIIB of FIG. 38A.
Figure 38C:
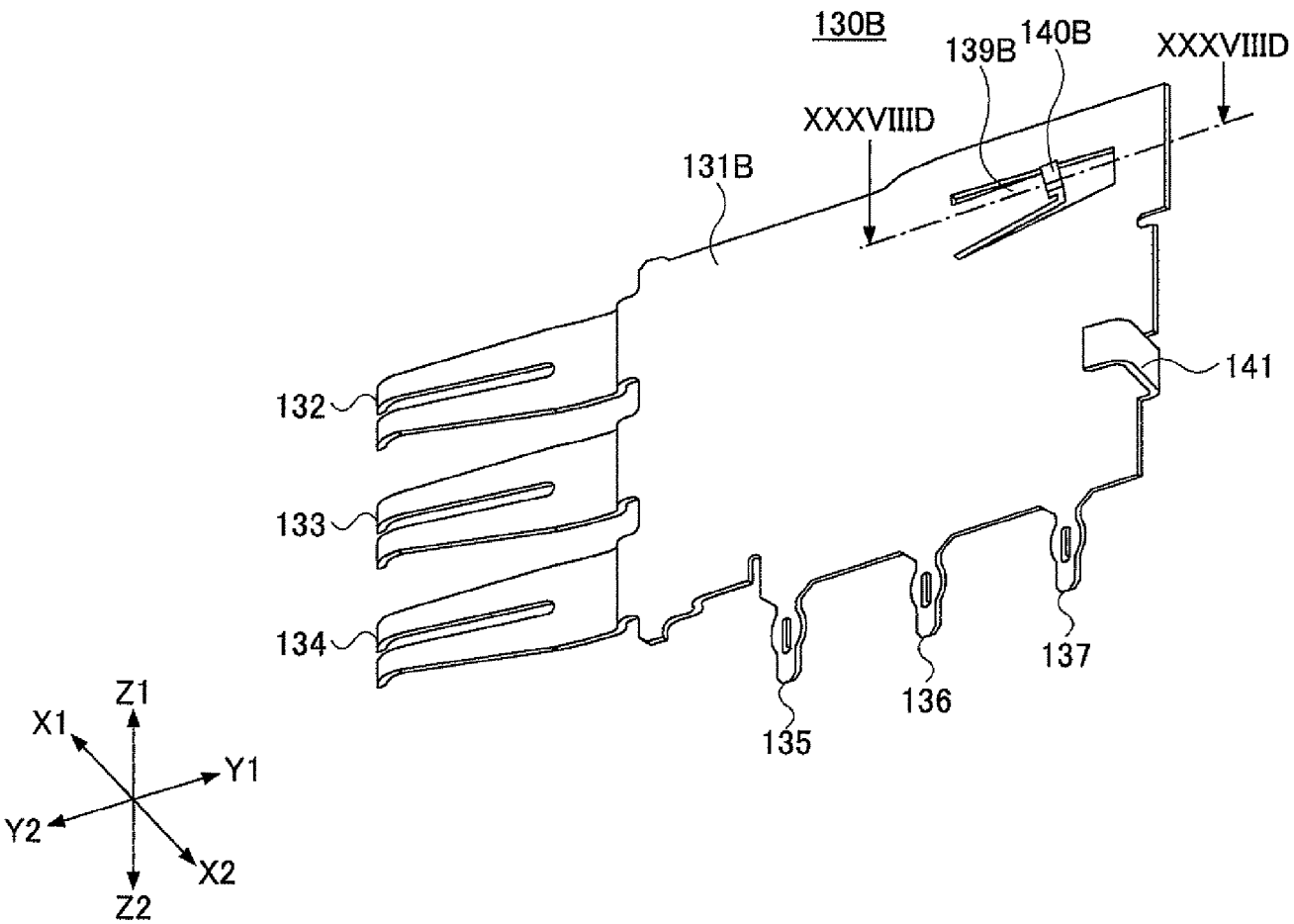
FIG. 38C is a perspective view of a shield member illustrated in FIG. 37.
Figure 38D:
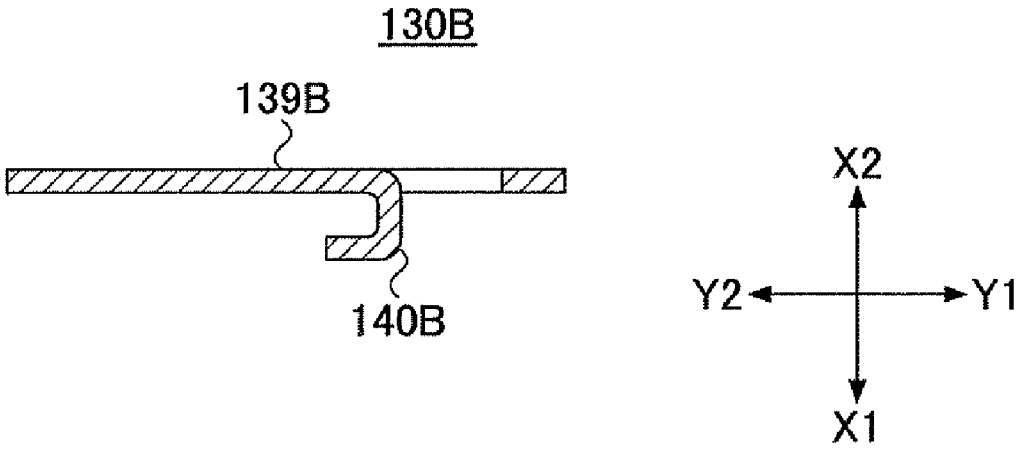
FIG. 38D is an enlarged cross-sectional view taken along a line XXXVIIID-XXXVIIID of FIG. 38C.
Figure 39A:
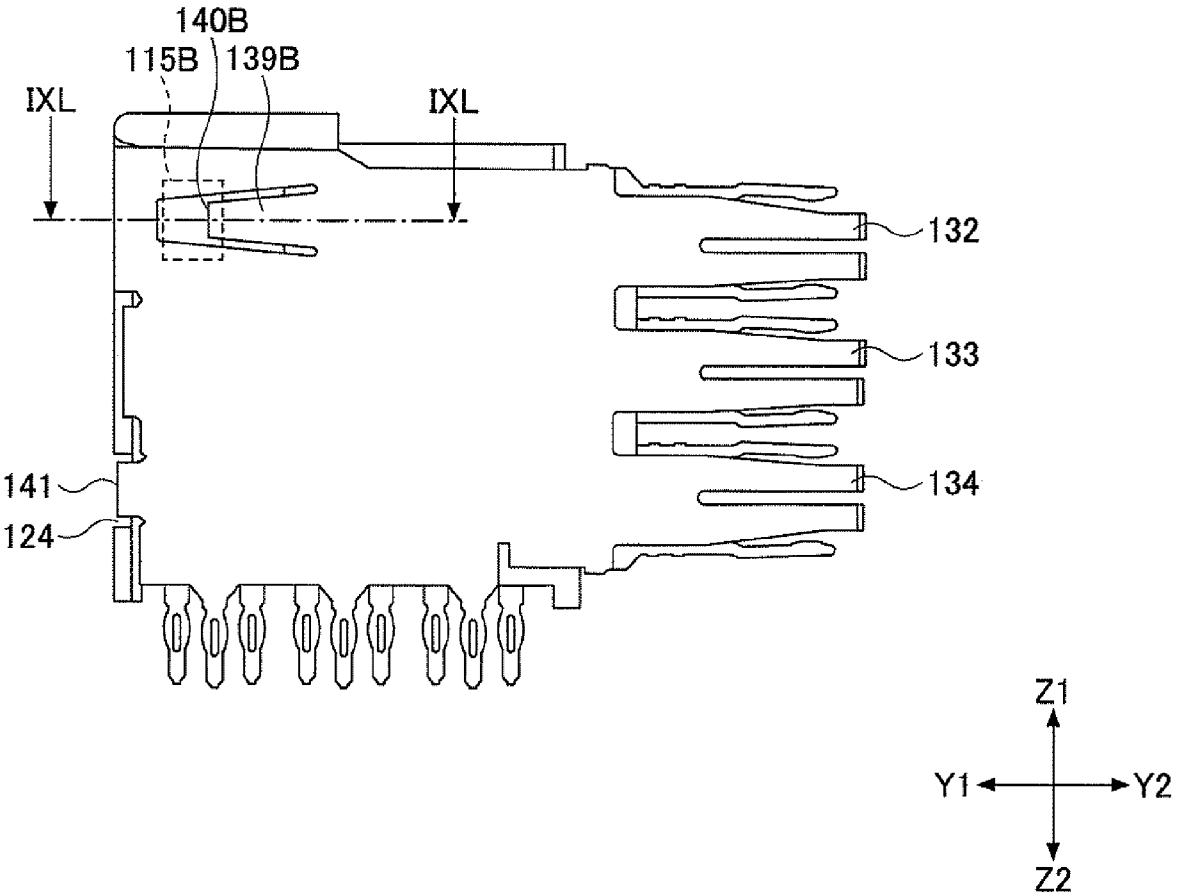
FIG. 39A is a front view of the contact module with the shield member attached thereto.
Figure 39B:
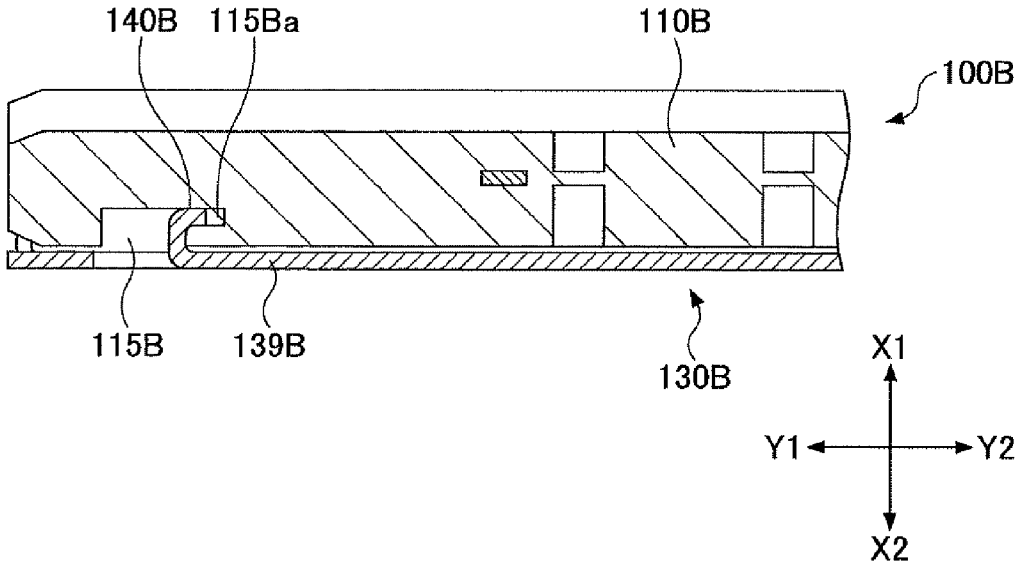
FIG. 39B is an enlarged cross-sectional view taken along a line IXL-IXL of FIG. 39A.

FIG. 37 is a perspective view of a jack connector 20B according to a third embodiment of the present invention. FIG. 38A is a perspective view of a contact module 100B. FIG. 38B is an enlarged cross-sectional view taken along a line XXXVIIIB-XXXVIIIB of FIG. 38A. FIG. 38C is a perspective view of a shield member 131B. FIG. 38D is an enlarged cross-sectional view taken along a line XXXVIIID-XXXVIIID of FIG. 38C. FIG. 39A is a front view of the contact module 100B with the shield member 130B attached thereto. FIG. 39B is an enlarged cross-sectional view taken along a line IXL-IXL of FIG. 39A.

As illustrated in FIG. 37, in the jack connector 20B, a plurality of contact modules 100B and shield members 130E are inserted into a housing 21B from the rear side so that the contact modules 100B and the shield members 130B are alternately arranged in the longitudinal direction of the jack connector 20B. The housing 21B has the same structure as the housing 21A of the jack connector 20A according to the above-mentioned second embodiment. The contact module 100B and the shield member 130E have substantially the same structures as the contact module 100A and the shield member 130A of the jack connector 20A according to the above-mentioned second embodiment.

A description will be given below of a difference in structure between the jack connector 20B according to the third embodiment and the jack connector 20A according to the second embodiment.

As illustrated in FIG. 38A, the module body 1102 of the contact module 1002 has a concave part 115B and a notch 124. As illustrated in FIG. 38B, the concave part 115B has an L-shaped cross section and has a deep part 115Ba extending in the Y2 direction.

As illustrated in FIG. 38C, the shield member 130B includes a lock piece 139A and a hook part 141. As illustrated in FIG. 38D, the lock piece 139B has a U-shaped hook part 140B at the end thereof. As illustrated in FIG. 39A, the shield member 130B is attached to the module body 110B of the contact module 1002 with the lock piece 139B being engaged with the concave part 115B and the hook part 141 being fit to the notch 124. As illustrated in FIG. 39B, the U-shaped hook part 140B is engaged with the deep part 115B of the concave part 115B.

According to the above-mentioned structure, the shield body part 131B of the shield member 130B, which is exposed at the end of the jack connector 20B on the X2 side, is prevented from being turned up due to the hook part 141 engaging with the contact module 100A to surround the notch 124 and the hook part 140E being engaged with the concave part 115.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention (s) has(have) been described in detail, it should be understood that the various changes, substitutions, and alterations could be made hereto without departing from the spirit and scope of the invention.

What is claimed is:

1. A connector comprising:

a housing;

a plurality of contact modules each comprising a contact module body and a plurality of contact members extending from the contact module body; and a plurality of shield members each including a shield body part corresponding to the contact module body of respective contact modules, wherein the contact modules and the shield members are alternately arranged in the housing, and the shield body part of each shield member includes a first hook part formed in a U-shape extending from a rear end of the shield body part, configured to surround and be engaged with a rear end of the contact module body.

2. The connector as claimed in claim 1, wherein the housing includes a shield member press part on a surface on a side where the shield members are exposed, the shield member press part configured to press the shield body part.

3. The connector as claimed in claim 1, wherein the shield body part is formed of a metal plate, and the first hook part is formed by bending a portion of the metal plate in a U-shape.

4. The connector as claimed in claim 1, wherein the contact module body of each contact module includes a concave part having an L-shaped cross section, and the shield body part of each shield member includes a lock piece having a U-shaped second book part on an extreme end thereof, wherein the U-shaped second hook part is engaged with the L-shaped concave part.

5. The connector as claimed in claim 4, wherein the shield body part is formed of a metal plate, and the U-shaped second hook part is formed by bending a portion of the metal plate.

6. A connector comprising:

contact modules each of which includes:

contact members;

a contact module body that holds the contact members;

a contact part of the contract members protruding in a forward direction from the contact module body; and contact module mounting terminals protruding in a downward direction from the contact module body, and shield members each of which includes:

a shield body part that corresponds to the contact module body of one of the contact modules;

shield piece parts protruding in a forward direction from the shield body part;

shield member mounting terminal parts protruding in a downward direction from the shield body part; and a hook having a U-shape extending from a rear end of the shield body part, that clips and surrounds a rear end portion of the contact module body.

7. The connector as claimed in claim 6, wherein the hook is provided at a position shifted from the center of the shield body part in a direction of height toward a side of the shield member mounting terminal part.

8. The connector as claimed in claim 7, wherein the hook is located at a middle position between the center of the shield body part in a direction of height and an end of the shield body part where the shield member mounting terminal part is located.

9. A connector comprising:

a plurality of contact modules each of which includes a contact member, and a contact module body holding the contact member; and a plurality of shield members each of which includes a shield body part engaged with the respective contact module body, and a hook having a U-shape provided at an end of the shield body part, wherein a rear end portion of each contact module is clipped between the shield body part and the hook such that the hook surrounds the rear end portion of the contact module.

* * * * *